US005485882A

United States Patent [19]

Bailey et al.

[11] Patent Number: 5,485,882

[45] Date of Patent: Jan. 23, 1996

[54] LOW-DENSITY BALL SEALER FOR USE AS A DIVERTING AGENT IN HOSTILE ENVIRONMENT WELLS

[75] Inventors: James R. Bailey, Missouri City; Larry E. Harrison, Houston, both of Tex.

[73] Assignee: Exxon Production Research Company, Houston, Tex.

[21] Appl. No.: 329,937

[22] Filed: Oct. 27, 1994

[51] Int. Cl.[6] ..... E21B 33/138; E21B 33/10; E21B 43/27; E21B 43/25

[52] U.S. Cl. ..... 166/284; 166/193

[58] Field of Search ..... 166/284, 281, 166/280, 193, 192; 428/402, 407; 137/268

[56] References Cited

U.S. PATENT DOCUMENTS

| | | | |
|---|---|---|---|
| 2,754,910 | 7/1956 | Derrick et al. | 166/284 |
| 4,102,401 | 7/1978 | Erbstoesser | 166/284 |
| 4,244,425 | 1/1981 | Erbstoesser | 166/284 |
| 4,407,368 | 10/1983 | Erbstoesser | 166/284 |
| 4,421,167 | 12/1983 | Erbstoesser | 166/284 X |
| 4,505,334 | 3/1985 | Doner et al. | 166/284 |
| 4,702,316 | 10/1987 | Chung et al. | 166/284 X |
| 5,253,709 | 10/1993 | Kendrick et al. | 166/284 |

*Primary Examiner*—Stephen J. Novosad
*Attorney, Agent, or Firm*—Kelly A. Morgan

[57] ABSTRACT

The invention is a rigid, hollow core, low-density ball sealer designed to perform effectively in hostile well environments. It temporarily seals perforations inside cased wells at temperatures up to 400° F. (204° C.), at hydrostatic pressures up to 20,000 psi (137 Mpa), and at differential pressures across the perforations up to 1,500 psi. Ball densities may range from 0.80 to 1.3 gm/cc (or higher). It can withstand the degradation effects of solvents common to oil and gas wells during a workover. Nominal changes in ball density occur during a 24-hour period when exposed to a hostile well environment. The ball sealer is comprised of two pieces made of a high strength material that snap together to form a hollow-core sphere. If necessary, adjustments to ball density can occur subsequent to manufacturing of the ball pieces.

22 Claims, 7 Drawing Sheets

LOW-DENSITY BALL SEALER FOR USE AS A DIVERTING AGENT IN HOSTILE ENVIRONMENT WELLS

FIELD OF THE INVENTION

This invention falls in the general area of well workover technology. More specifically, the invention relates to an improved low density ball sealer for redirecting the flow of stimulation fluids during the treatment of a cased, perforated hostile environment well.

BACKGROUND OF THE INVENTION

It is common practice in completing oil and gas wells to set a string of pipe, known as casing, in the well and use a cement sheath around the outside of the casing to isolate the various formations penetrated by the well. To establish fluid communication between the hydrocarbon-bearing formations and the interior of the casing, the casing and cement sheath are perforated. At various times during the life of the well, it may be desirable to increase the production rate of hydrocarbons using appropriate treating or stimulation fluids such as acids, solvents or suffactants. If only a short, single pay zone in the well has been perforated, the treating fluid will flow into the pay zone where it is needed. As the length of the perforated pay zone or the number of perforated pay zones increases, the placement of the treating or stimulation fluid in the regions of the pay zones where it is needed becomes more difficult. For instance, the strata having the highest permeability will most likely consume the major portion of a given stimulation treatment, leaving the least permeable strata virtually untreated.

Various techniques have been developed to redirect stimulation fluids towards lower permeability zones to ensure that damaged formations are sufficiently exposed to these fluids. One such technique for achieving diversion involves the use of downhole equipment such as packers. Although these devices can be effective, they are quite expensive due to the involvement of associated workover equipment required during the tubing-packer manipulations. Additionally, mechanical reliability tends to decrease as the depth of the well increases. As a result, considerable effort has been devoted to the development of alternative diverting methods for cased and perforated wells.

One such alternative is to redirect stimulation fluids toward lower permeability zones by using ball sealers to temporarily block perforations that exist across higher permeability zones. Generally, the ball sealers are pumped into the wellbore along with the formation treating fluid and are carried down the wellbore and onto the perforations by the flow of the fluid through the perforations into the formation. The balls seat upon the perforations receiving the majority of fluid flow and, once seated, are held there by the pressure differential across the perforations. The ball sealers are injected at the surface and transported by the treating fluid. Other than a ball injector and possibly a ball catcher, no special or additional treating equipment is required. Major advantages of utilizing ball sealers as a diverting agent include ease of use, positive shutoff, no involvement with the formation, and low risk of incurring damage to the well. As described further below, ball sealers are typically designed to be chemically inert in the environment to which they are exposed; to effectively seal, yet not extrude into the perforations; and to release from the perforations when the pressure differential into the formation is relieved.

The oil and gas industry began using ball sealers as a diverting agent around 1956. Since that time the majority of wells have been completed at depths less than 15,000 ft, and as a result most commercially available ball sealers are designed to perform at temperatures and at pressures commonly associated with wells of depths less than 15,000 ft. In most cases these wells will have temperatures less than 250° F. and maximum bottomhole pressures not exceeding 10,000 to 15,000 psi during a workover. In recent years, however, technological developments have enabled the oil and gas industry to drill and complete wells at depths exceeding 15,000 ft., which will often have higher temperatures and pressures. For example, at a depth of around 25,000 ft., wellbore temperatures can exceed 400° F., with bottomhole pressures approaching 20,000 psi during a workover. In addition to the high temperatures and pressures, wells completed at these depths often produce fluids like carbon dioxide ($CO_2$) or hydrogen sulfide ($H_2S$), and the stimulation fluid used may be a solvent like hydrochloric acid (HCl). Thus, conducting a workover using ball sealers in deep, hostile environment wells requires ball sealers capable of withstanding high pressures and temperatures while exposed to gases and solvents. The ball sealers must also resist changes in density to ensure satisfactory seating efficiencies result during a workover.

Most commercially available ball sealers will have a solid, rigid core (which resists extrusion into or through a perforation in the formation) and an outer coveting sufficiently compliant to seal, or significantly seal, the perforation. The ball sealers should not be able to penetrate the formation since penetration could result in permanent damage to the flow characteristics of the well. Commercially available ball sealers are typically spherical with a hard, solid core made from nylon, phenolic, syntactic foam, or aluminum. The solid cores may be covered with rubber to protect them from solvents and to enhance their sealing capabilities. Ball sealer diameters typically range from ⅝-in to 1 ¼ in, with specific gravities ranging from 0.8 to 1.9. With the exception of syntactic foam cores, most of the rubber-coated balls are designed to withstand hydrostatic pressures below 10,000 psi at temperatures below 200° F. Specific gravities of rubber-coated balls typically range from 0.9 to 1.4. Ball sealers with syntactic foam cores are capable of withstanding hydrostatic pressures up to 15,000 psi at temperatures up to 250° F., and have specific gravities ranging from 0.9 to 1.1.

These ball sealers will, however, begin to degrade when temperatures or pressures exceed the design limits. Degradation can also occur when exposing ball sealers to fluids like HCl, $CO_2$, or $H_2S$. Additionally, in the case of rubber coated ball sealers, the perforation can actually cut the rubber coating in the area of the pressure seal. Once the ball sealer loses its structural integrity, the unattached rubber is free to lodge permanently in the perforation which can reduce the flow capacity of the perforation and may permanently damage the well. The cut rubber coating will also result in exposure of the ball core material to the stimulation fluid, possibly resulting in dissolution of the core material. The capability of a ball sealer to block a perforation will diminish notably if degradation results in excessive ball deformation or in a breakdown of ball material. A ball sealer must remain essentially undeformed and intact under high pressures and temperatures to effectively block a perforation during a workover. Thus, material strength and environmental resistance are important aspects of ball sealer design.

Another important aspect of ball sealer design is density (or specific gravity). Past research and field studies indicate that the number of ball sealers that will seat onto perforations located inside a well (seating efficiency) depends on several factors, including the relative density of the ball sealer and the wellbore fluid. Erbstoesser (see "Improved Ball Sealer Diversion," SPE Paper 8401, 1979) observed that maximum seating efficiencies occurred when the ball density was 0.02 gm/cc less than the workover fluid density which typically ranges from 0.8 to 1.3 gm/cc. Thus, most workovers will require a low-density ball sealer in order to enhance seating efficiencies. Ball sealer density should also remain essentially constant to minimize changes between the relative density of the ball sealer and the wellbore fluid during a workover. There are various materials having high temperature and high pressure resistances. However, the problem with using these materials for a solid core ball sealer design is that these materials will typically have a high density as compared to common treating fluids. As a result, this higher density can prevent current commercial, solid core ball sealer designs made of such high strength materials from seating against the perforations.

Another potential problem with commercial ball sealers is quality control during ball manufacturing. The densities of ball sealers delivered for use during a workover will often vary notably from specified values. The lack of proper quality control when forming the solid core material, coupled with irregularities when applying the rubber coating, can cause variations in the overall ball density, and such variations can notably affect seating efficiencies during a workover. Current ball sealer designs do not allow for adjustments to be made to the ball sealer density prior to initiation of a workover. Thus, because of inventory costs, only a select range of ball sealer densities are typically available for immediate use.

To summarize, deeper drilling has demanded stimulation jobs that are conducted under conditions that exceed the current temperature, pressure, and well-condition limitations of available low density ball sealers. Available low density ball sealers are not designed to withstand temperatures over 200°–250° F., hydrostatic pressures over 10,000–15,000 psi, or differential pressures over 1,500 psi (at these high temperatures and hydrostatic pressures). They are currently unable to perform effectively when exposed to hostile well environments: They deform excessively when exposed to the high temperatures and high bottomhole pressures often associated with deeper wells, particularly during long workovers or when exposed to solvents. Furthermore, those commercial ball sealers designed to withstand higher pressures or temperatures (e.g. rubber-covered, high strength, solid phenolic core) will have densities higher than the stimulation fluids used during the workover. Thus, the ball sealers will either not seat at all or seating efficiencies will decrease. The ability of commercial ball sealers to perform satisfactorily will decrease notably as temperatures begin to exceed 200° F. (93° C.). Ball sealer performance is limited further when hydrostatic pressures exceed 10,000 psi or when differential pressures across the perforations exceed 1,500 psi at high temperatures and pressures. Such conditions are common during workovers in deep, hostile environment wells. For the foregoing reasons, a need exists for improved low density ball sealers which function properly in such hot, hostile environment wells, especially in the presence of acidic fluids.

DESCRIPTION OF THE RELATED ART

Claims for ball sealer designs began in 1955 with Derrick et al (U.S. Pat. No. 2,754,910). They claimed a method for plugging perforations using spherical and polygonal shaped solid and hollow cores made from materials (light metal alloys, thermoplastics, thermosets) with a soft, thin coating applied to the surface. Derrick did not, however, discuss or suggest using high strength materials (which are typically very dense) for a rigid, thick-walled, hollow core ball or using his ball sealers in high temperature (>200° F.), high pressure (>10,000 psi) applications. In fact, Derrick's discussion is limited to applications at 10,000 psi. As previously mentioned, this pressure was considered high for the times. In 1978 Erbstoesser (U.S. Pat. No. 4,102,401) first introduced the concept of using solid core syntactic foam balls, or glass micro-spheres mixed with epoxy. This material is a hard, lightweight material capable of withstanding high pressures. In 1983, Erbstoesser further advanced the idea of using a more durable, rubber-like material called polyurethane (U.S. Pat. No. 4,407,368) as a coating for syntactic foam balls. In 1985, Doner, et at. (U.S. Pat. No. 4,505,334) described a method for making ball sealers by wrapping a thermostatic filament around a core, then curing the material. An elastomeric outer covering was described as optional. In 1987, Chung, et at. (U.S. Pat. No. 4,702,316) described a method for diverting steam in injection wells using ball sealers comprised of polymer compounds covered with a thin elastomer coating. These polymer compounds included polystyrene, polymethyl groups and polydimethol groups. In 1993, Kendrick and Savage (U.S. Pat. No. 5,253,709) described a method for sealing perforations using ball sealers comprised of a spherical deformable (.rather than rigid) shell filled with a nondeformable particulate. They claimed that, while flowing with the shape of the deformable outer shell, the particulates should be at least one-sixth the perforation diameter to ensure that they consolidate under the force of fluid flow pressure to form essentially a solid core. Ball specific gravities ranged from 1.0 to 1.3, but no pressure or temperature ratings were provided.

All of these more recent ball sealer designs resulted from an effort to develop a lower density ball that could withstand high temperatures and pressures or would seal more effectively. The problems, however, with these inventions include manufacturing costs, density control, and performance limits, particularly with respect to hostile well environments.

SUMMARY OF THE INVENTION

The present invention relates to a method for treating a subterranean formation surrounding a cased well having an interval provided with a plurality of perforations. Ball sealers, suspended in a treating fluid, are flowed down the casing to the perforated interval of the casing where treatment in the formation is not needed. The ball sealers are comprised of first and second halves designed to sealably engage and form a rigid, hollow core spherical shell. One benefit to this type of design is that density can be adjusted prior to ball assembly, and in one embodiment after ball assembly by inserting a filler material between the halves. The ball sealers have a density less than the density of the treating fluid and are sized to substantially seal the perforations. Each of the hollow core ball sealers will have a density in the range of about 0.8 g/cc to about 1.3 g/cc and will be comprised of a spherical shell, where the ratio of the spherical shell outer radius to the spherical shell thickness is less than 10. The flow of the treating fluid is continued until the ball sealers engage and substantially seal at least a portion of the perforations. As a result, the treating fluid is diverted to the unsealed portions of the perforated interval thereby providing an effective means for injecting treating fluids through desired well perforations.

In a preferred embodiment, the ball sealers are comprised of a high strength aluminum or a high strength thermoplastic. The ball sealers will preferably have either a beveled joint or a straight joint, and may also have a protective coating depending on the ball sealer material, the produced fluid, and the treating fluid. Ball sealers of the inventive design, made from such high strength materials, are particularly useful in hostile environment wells, where temperatures range from about 300° F. (149° C.) to about 400° F. (204° C.), hydrostatic pressures range from about 10,000 psi to about 20,000 psi, and where differential pressures can exceed 1,500 psi.

BRIEF DESCRIPTION OF THE DRAWINGS

Several advantages of the inventive low density ball sealer will be better understood by referring to the following detailed description and the attached drawings.

DETAILED DESCRIPTION OF THE PREFERRED EMBODIMENTS

Figure 1:
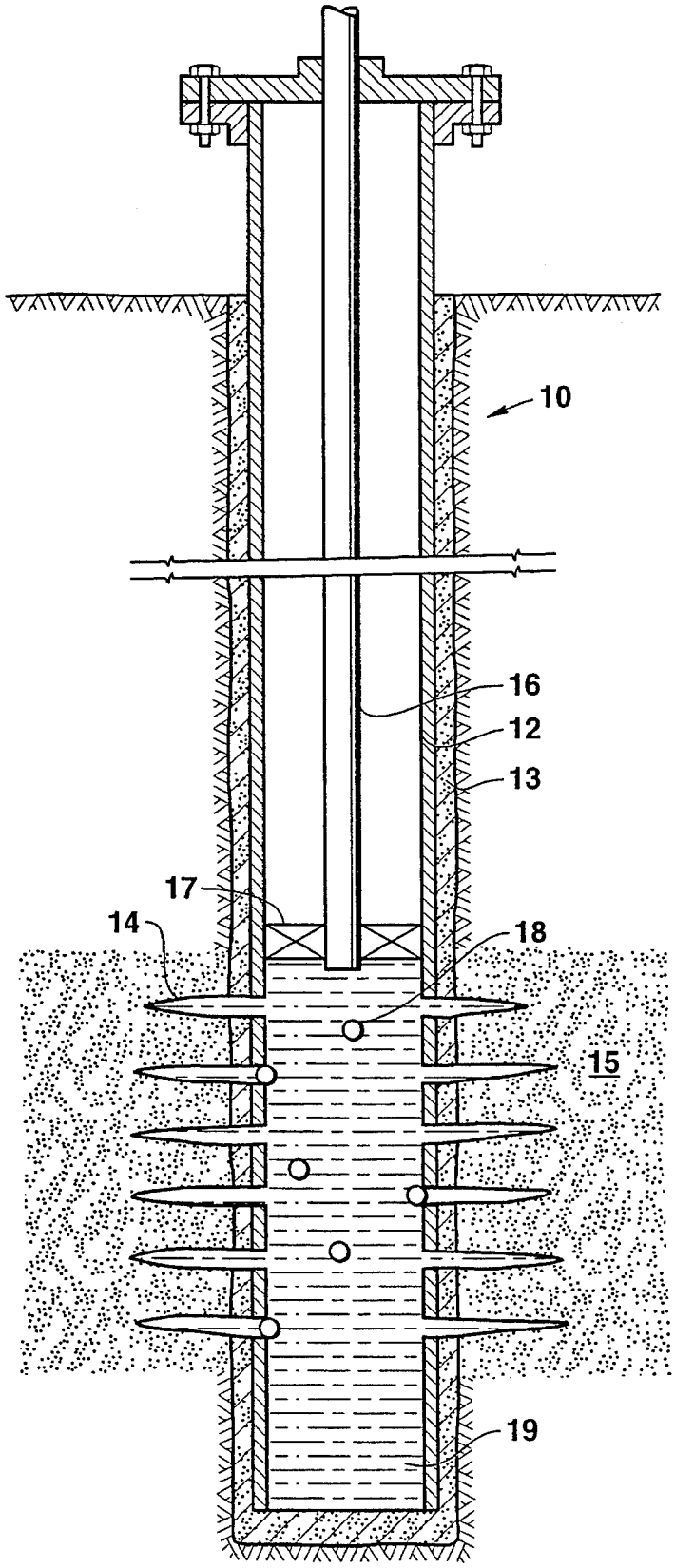
FIG. 1 is an elevation view in section of a well illustrating the practice of the present invention.

Utilization of the present invention according to a preferred embodiment is depicted in FIG. 1. The well 10 of FIG. 1 has a casing 12 extending for at least a portion of its length and is cemented around the outside to hold the casing 12 in place and isolate the penetrated formation or intervals. The cement sheath 13 extends upward from the bottom of the wellbore in the annulus between the outside of the casing 12 and the inside wall of the wellbore at least to a point above producing strata 15. For the hydrocarbons in the producing strata 15 to be produced, it is necessary to establish fluid communication between the producing strata 15 and the interior of the casing 12. This is accomplished by perforations 14 made through the casing 12 and the cement sheath 13 by means known to those of ordinary skill. The perforations 14 form a flow path for fluid from the formation into the casing 12 and vice versa.

The hydrocarbons flowing out of the producing strata 15 through the perforations 14 and into the interior of the casing 12 may be transported to the surface through a production tubing 16. A production packer 17 can be installed near the lower end of the production tubing 16 and above the highest perforation 14 to achieve a pressure seal between the production tubing 16 and the casing 12. Production tubings 16 are not always used and, in those cases, the entire interior volume of the casing 12 is used to conduct the hydrocarbons to the surface of the earth.

When diversion is needed during a well treatment, ball sealers 18 are used to or substantially seal some of the perforations. Substantial sealing occurs when flow through a perforation 14 is significantly reduced as often indicated by an increase in wellbore pressure as a ball sealer 18 blocks off a perforation 14. These ball sealers 18 are preferred to be approximately spherical in shape, but other geometries may be used. Using ball sealers 18 to plug some of the perforations 14 is accomplished by introducing the ball sealers 18 into the casing 12 at a predetermined time during the treatment. When the ball sealers 18 are introduced into the fluid upstream of the perforated parts of the casing 12, they are carded down the production tubing 16 or casing 12 by the treating fluid 19 flow. Once the treating fluid 19 arrives at the perforated interval in the casing, it flows outwardly through the perforations 14 and into the strata 15 being treated. The flow of the treating fluid 19 through the perforations 14 carries the ball sealers 18 toward the perforations 14 causing them to seat on the perforations 14. Once seated on the perforations 14, ball sealers 18 are held onto the perforations 14 by the fluid pressure differential which exists between the inside of the casing 12 and the producing strata 15 on the outside of the casing 12. The ball sealers 18 are preferably sized to substantially seal the perforations, when seated thereon. The seated ball sealers 18 serve to effectively close those perforations 14 until such time as the pressure differential is reversed, and the ball sealers 18 are released.

The ball sealers 18 will tend to first seal the perforations 14 through which the treating fluid 19 is flowing most rapidly. The preferential closing of the high flow rate perforations 14 tends to equalize treatment of the producing strata 15 over the entire perforated interval. For maximum effectiveness in seating on perforations 14, the ball sealers 18 preferably should have a density less than the density of the treating fluid 19 in the wellbore at the temperature and pressure conditions encountered in the perforated area downhole. If a ball sealer 18 is not sufficiently strong to withstand these temperatures and pressures, it will collapse, causing the density of the ball sealer 18 to increase to a density which can easily exceed the treating fluid density. Under such conditions, the ball sealers 18 may not seat at all or seating efficiency will decrease and thus performance will decline. Another possibility is that once seated, the ball sealers 18 may begin extruding into the perforations 14 and then block or permanently seal them, thus detrimentally affecting well production following completion of the workover. The number of ball sealers needed during a workover depends on the objectives of the stimulation treatment and can be determined by one skilled in the art.

The various embodiments of the inventive ball sealer are highly suitable for use in deep wells (deeper than 15,000 ft.) where bottom hole pressures during stimulation will generally be in the range of 10,000–20,000 psi and temperatures in the range of about 300° F. (149° C.) to about 400° F. (204° C.). Also, the pressure differential across each of the perforations may, in some instances, be in excess of 1,500 psi. It may also be preferable to use the inventive ball sealer when the temperatures are in the range of about 200° F. to about 300° F. with hydrostatic pressures exceeding 15,000 psi and differential pressures exceeding 1,500 psi, especially when the stimulation treatment requires a low density ball sealer.

Generally, the invention is a low density ball sealer that can withstand the degradation effects of solvents common to oil and gas wells during a workover. It is also designed to resist changes in density during at least about a 24-hour period, although it is believed that longer periods of time could be endured. Densities may range from 0.80 to 1.3 gm/cc by varying the wall thickness. The inventive ball sealer is comprised of two halves that are designed to sealably engage with each other to form a hollow-core spherical shell. A coating can be applied to protect the core material, if necessary. This design enables manufacturers to enhance their quality control efforts to ensure that a ball sealer meets customer specifications in terms of ball sealer size, density, and environmental ratings. Finally, the two-piece, hollow core design allows adjustments to ball sealer density to occur prior to assembly. And in one embodiment, adjustments to ball sealer density can be made after initial assembly by opening the ball sealer, adding a filler material between the two halves, and reassembling the ball sealer. This flexibility is important when changes to a workover plan occur, resulting in the need to change the ball sealer density after the ball sealer has already been manufactured.

Figure 2:
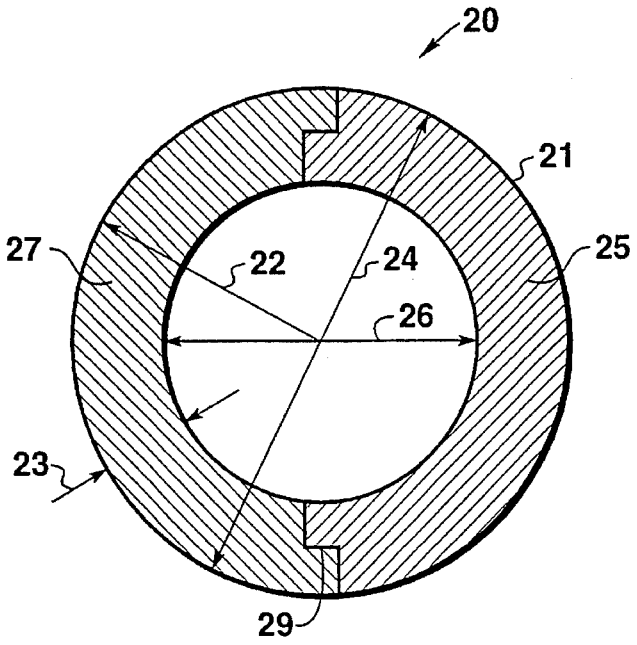
FIG. 2 is a cross sectional view through the center (and oriented perpendicular to the ball joint) of one embodiment of the ball sealer of the present invention, said ball sealer having a hollow core and being formed by female and male halves, which are joined with a beveled joint.
Figure 3A:
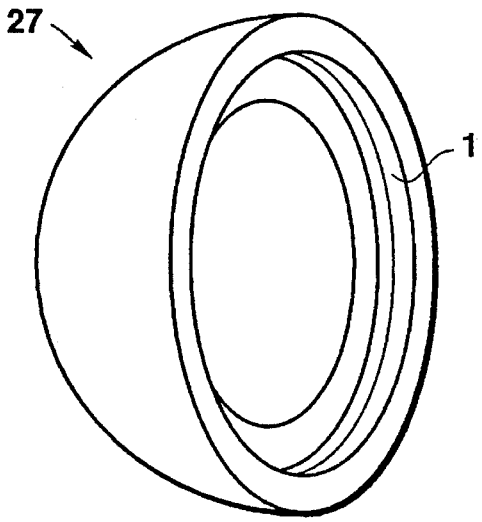
FIGS. 3A and 3B are isometric views of the female and male halves, respectively, of one embodiment of said ball sealer.
Figure 3B:
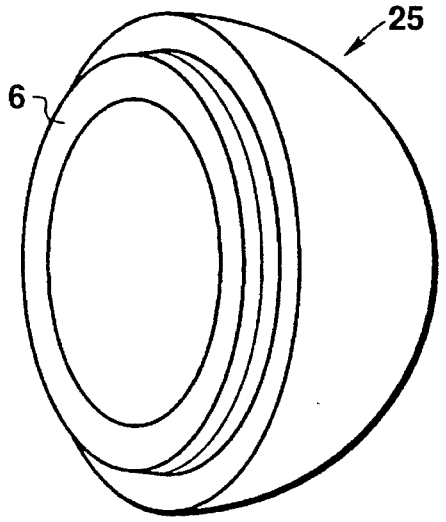

A preferred embodiment of the inventive ball sealer is depicted in FIGS. 2–5. FIG. 2 illustrates ball sealer 20 which is comprised of a spherical shell 21, wherein the ratio of the spherical shell 21 outer radius 22 to the spherical shell thickness 23 is less than 10. Ball sealer 20 is formed by a male half 25 and a female half 27, which are pressed together to form spherical shell 21. The female half 27 and the male half 25 are pictured in FIGS. 3A and 3B, respectively. Referring back to FIG. 2, the beveled joint 29 along the circumference of each half ensures that the two halves (25 & 27) will not slip or pull apart once assembled. For reasons described further below, the preferred ball sealer 20 material is either a high strength aluminum or a high strength thermoplastic. These materials are advantageous because they have high strength-to-weight ratios when compared to other readily available materials. Note also that, unlike high performance thermoplastics with good environmental ratings (i.e., those which are capable of maintaining their mechanical properties when exposed to solvent and/or to high temperatures), ball sealers made from high strength aluminum will require a protective coating (not shown in FIGS. 7A–7D) when exposed during a workover to solvents like HCl or hostile production fluids such as $CO_2$ or $H_2S$.

The beveled joint 29 (shown assembled in FIG. 2 and unassembled in FIGS. 3–5) requires a spherical shell thickness 23 which will provide sufficient material to form the beveled joint 29. The ratio of the spherical shell 21 outer radius 22 to the spherical shell 21 wall thickness 23 should be less than 10 to ensure that the ball sealer 20 behaves as a thick-wall shell. Ball resistance to hydrostatic pressure increases with thick-wall shell designs. The ratio of bending stresses to membrane stresses is appreciable for thick wall shells of revolution. Therefore spherical shells of constant thickness will withstand higher hydrostatic pressures when compared to thin spherical shells of the same diameter. Formulas used to calculate the compressive stress in a spherical shell reveal that the maximum compressive stress in a thick-wall shell approaches the value calculated for a thin wall shell as the ratio of the shell radius (measured from center to midplane of wall) to wall thickness approaches 10. Thus this limitation is critical to ensure that the ball sealers will behave as thick-walled shells and thus have a greater resistance to hydrostatic pressure than a thin-walled ball.

Figure 4B:
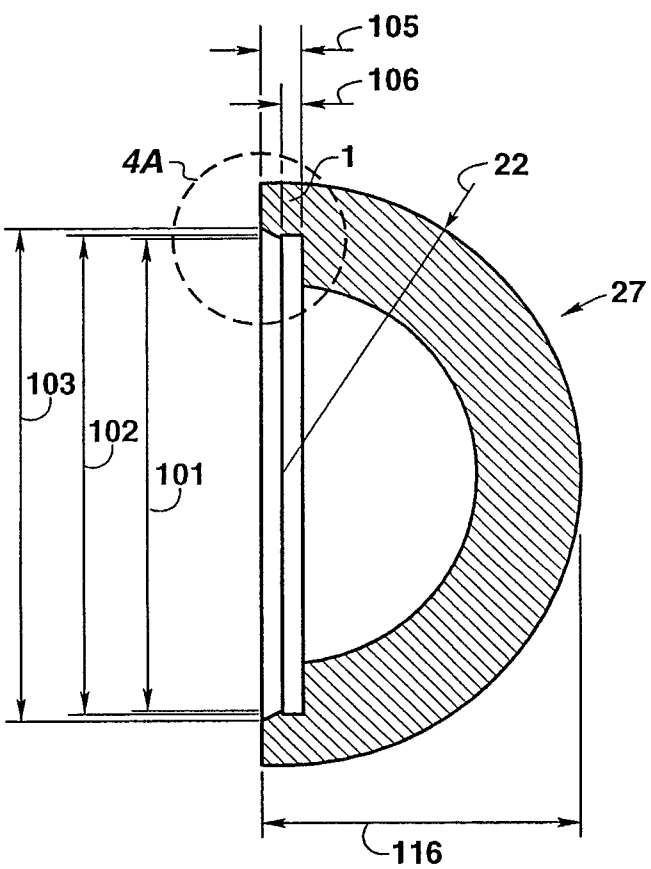
FIG. 4B is a cross sectional view of the female half of one embodiment of said inventive ball sealer, and having a partial enlarged view (FIG. 4A) of the female joint half of said female half of the ball sealer.
Figure 4A:
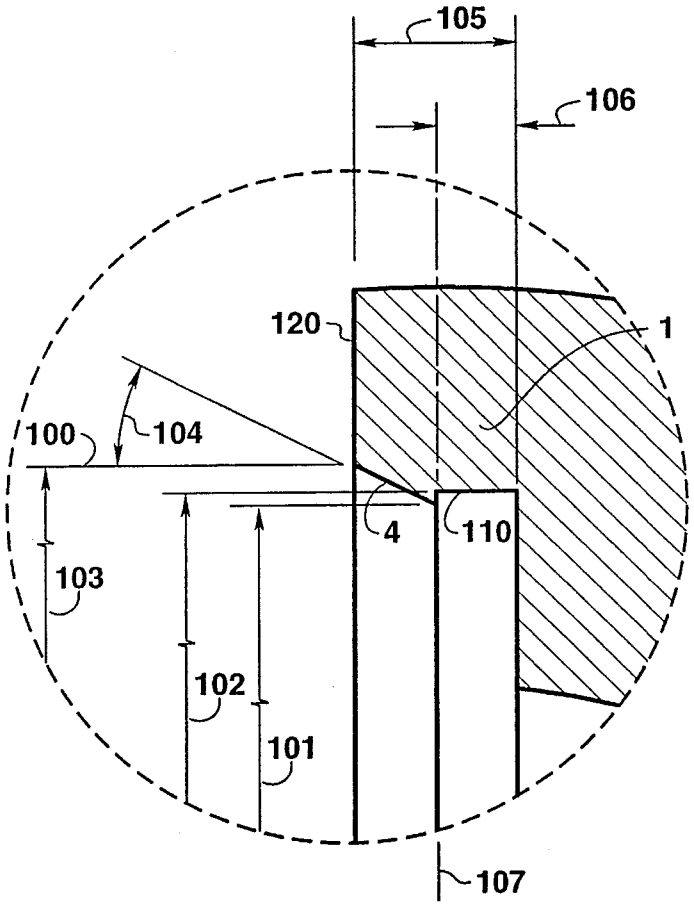
Figure 5B:
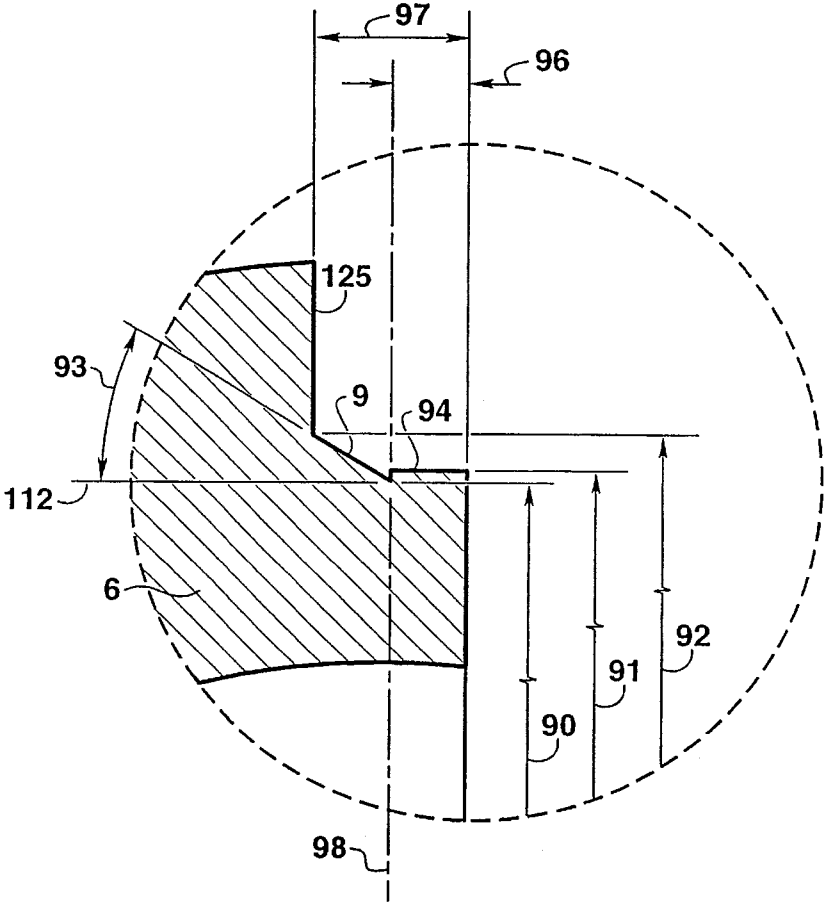
FIG. 5A is a cross sectional view of the male half of one embodiment of said inventive ball sealer, and having a partial enlarged view (FIG. 5B) of the male joint half of said male half of the ball sealer.
Figure 5A:
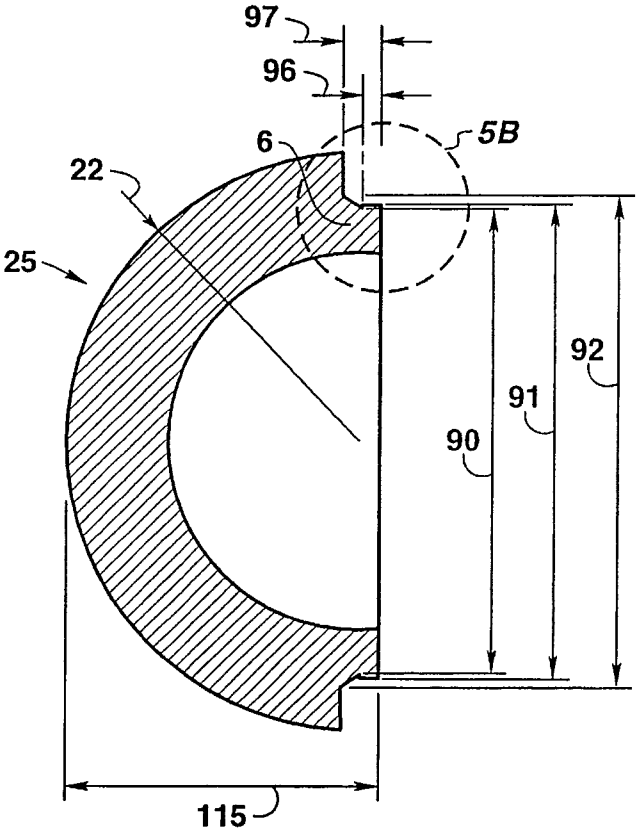

FIGS. 4A, 4B, 5A and 5B provide a more detailed view of the beveled joint 29 of the ball sealer 20 illustrated in FIGS. 2 and 3. The beveled joint 29 consists of a female joint half 1 (FIG. 4A and 4B) and a male joint half 6 (FIGS. 5A and 5B). Referring now to FIGS. 4A and 4B, the female joint half 1 is formed around the edge of the female half 27 of the ball sealer 20. An enlarged partial view of the female joint half 1 is illustrated in FIG. 4A. The female joint half 1 has an interior beveled edge 4, a female lip 110, a lip diameter 102, an inner bevel diameter 101 and an outer bevel diameter 103. The female joint half 1 has a total width 105. The female face 120 is formed on female joint half 1 at a distance 116 measured normal to the female face 120. The female lip 110 has a total width 106 as measured from the center line 107. The beveled edge 4 is formed on the female joint half 1 at an angle 104 measured from the reference plane 100 of the outer bevel diameter 103. To form the female lip 110, the lip diameter 102 should be larger than the inner bevel diameter 101, but smaller than the outer bevel diameter 103.

The male joint half 6 is formed around the edge of the male half 25 of the ball sealer 20. An enlarged partial view of the male joint half 6 is illustrated in FIG. 5B. The male joint half 6 has an exterior beveled edge 9 designed to sealably engage with the female beveled edge 4 when the male joint half 6 and the female joint half 1 are pressed together. The male joint half 6 has a male lip 94, a lip diameter 91, an outer bevel diameter 92 and an inner bevel diameter 90. The male joint half 6 has a total width 97. The male face 125 is formed on the male joint half 6 at a distance 115 measured normal to the male face 125. The male lip 94 has a total width 96 as measured from the centerline 98. The male beveled edge 9 is formed on the male joint half 6 at an angle 93 measured from the reference plane 112 of the inner bevel diameter 90. The angle 93 of the male beveled edge 9 is the same as the angle 104 of the female beveled edge 4. To form the male lip 94, the lip diameter 91 should be larger than the inner bevel diameter 90, but smaller than the outer bevel diameter 92.

Engagement of the comers, formed by the intersection of the beveled edge 4 and the female lip 110 (FIG. 4A), and by the beveled edge 9 and the male lip 94 (FIG. 5B), ensures that the female joint half 1 and the male joint half 6 lock when snapped together. The beveled edges 4 and 9 reduce the amount of force required to snap the ball halves (25 & 27) together. The total female 105 and male 97 joint widths, as well as the female 106 and the male 96 lip widths, should be designed to optimize the strength of the joint 29. As can be seen from the FIGS. 4 and 5, the male lip width 96 and the female lip width 106 are each about half of the total joint widths, respectively, 97 and 105 (which are equivalent). The beveled joint design 29 is preferable since it works to prevent the ball halves (25 & 27) from pulling apart. Thus, an exterior coating is not necessary to keep the ball halves (25 & 27) together.

Figure 6:
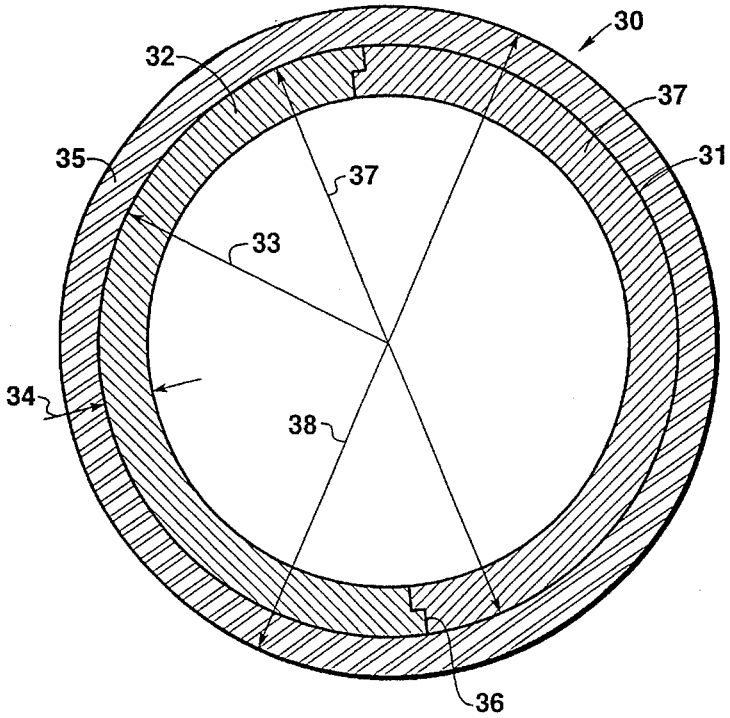
FIG. 6 is a cross sectional view through the center (and oriented perpendicular to the ball joint) of another embodiment of the ball sealer of the present invention, said ball sealer having a hollow core, two halves sealably engaged by a straight joint, and a protective coating.

FIG. 6 shows another embodiment of the inventive ball sealer of the present invention. As previously mentioned, unlike high performance thermoplastics with good environmental ratings, ball sealers made from high strength aluminum require a protective coating when exposed to solvents like HCl during a workover. Coated ball sealer 30 is comprised of a spherical shell 31 and is designed so that the ratio of the spherical shell 31 outer radius 33 to the spherical shell 31 thickness 34 is less than 10. The ball sealer 30 has a protective coating 35. Although a variety of materials like Buna-N exist for use as the protective coating 35, the more durable type of materials include polyurethane and ethylene propylene. In a preferred embodiment of the ball sealer 30, the minimum coating 35 thickness 34 should be 0.030 inches (0.8 mm). Because the protective coating 35 prevents the two halves 32 and 37 from slipping or pulling apart, coated ball sealer 30 requires a less complex joint 36 than the beveled joint 29 shown in FIGS. 2–5. A straight joint 36, will be sufficient for the coated ball sealer 30 described above.

Figure 7A:
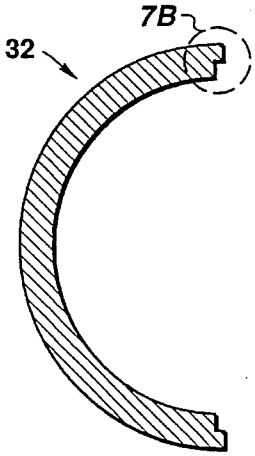
FIGS. 7A and 7C are cross sectional views of the two halves of the ball sealer depicted in FIG. 6, but without a coating, and each having an enlarged partial view (7B and 7D, respectively) of the straight joint halves.
Figure 7B:
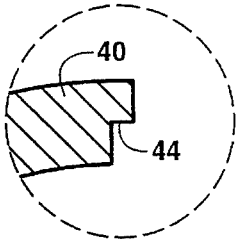
Figure 7D:
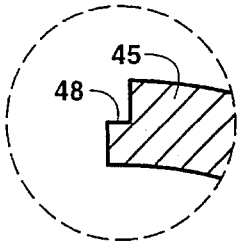
Figure 7C:
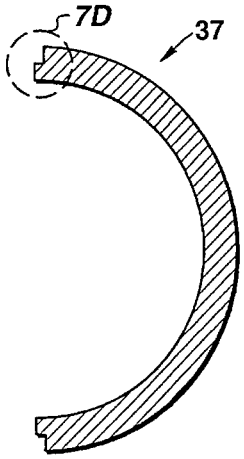

The straight joint 36 is shown in more detail in FIGS. 7A–7D. FIGS. 7A and 7C show, respectively, the female 32 and male 37 halves of ball sealer 30, which when assembled forms spherical shell 31. The protective coating is not shown in FIGS. 7A and 7C. Straight joint 36 is comprised of female joint half 40 which is formed around the edge of female half 32. The female joint half 40 is illustrated in an enlarged partial view (FIG. 7B) and has a straight edge 44 rather than the beveled edge required of the beveled joint 29 (FIGS. 2–5). Male half 37 has a male joint half 45 formed on the edge of the male half 37. The male joint half 45 is illustrated in an enlarged partial view (FIG. 7D) and has a straight edge 48 designed to sealably engage with the straight edge 44 of the female joint half 40 when the female 32 and male 37 ball halves are assembled to form ball sealer 30. In a preferred embodiment, the minimum shell thickness 34 needed to ensure that the ball sealer 30 remains intact is 0.031 inches.

Figure 8:
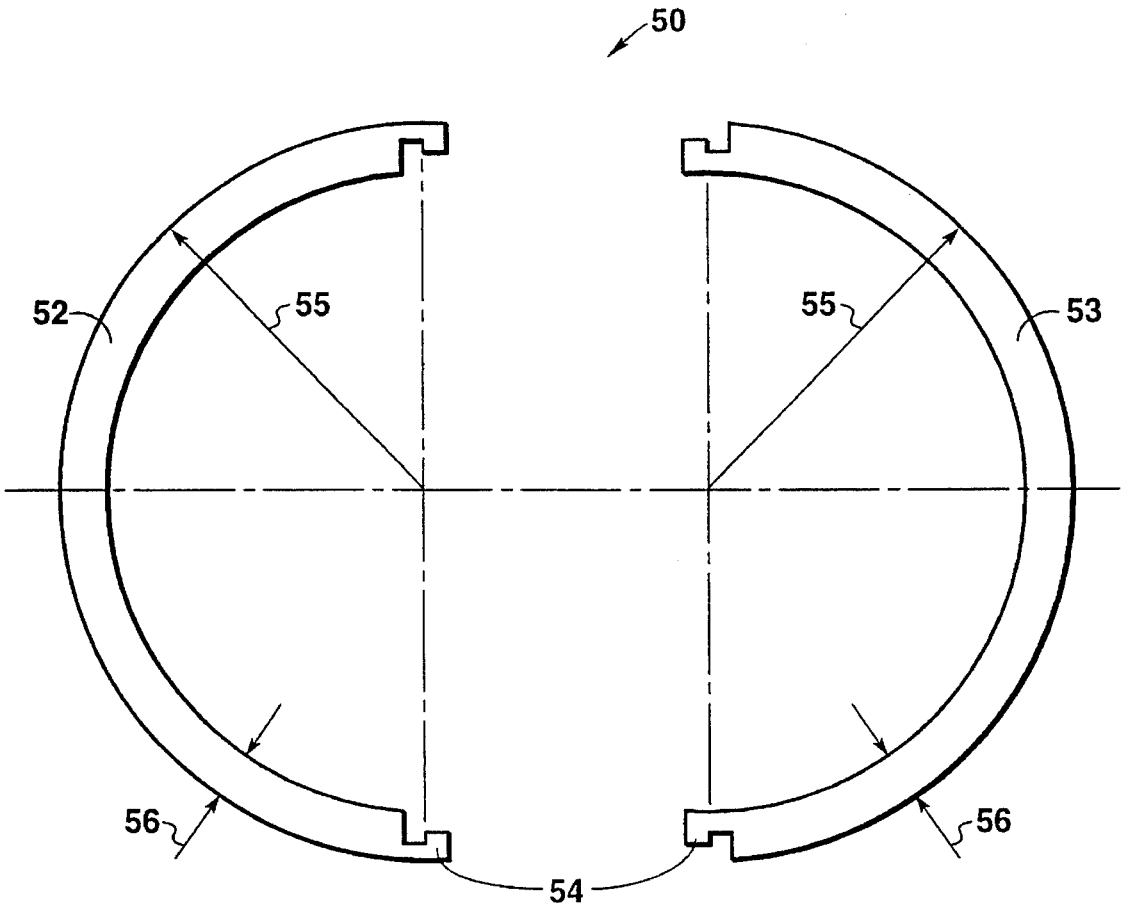
FIG. 8 is a cross sectional view of the first and second halves of a thinner walled ball sealer having a notched joint.

FIG. 8 illustrates another embodiment of the ball sealer of the present invention. Some well workovers will require a low density ball to enhance diversion effectiveness during a workover, but will use fluids that have a nominal effect on the ball material when compared to solvents. As a result, a protective coating will not be required. For example, aluminum balls transported in brine solutions do not require a coating for protection, but will often require a thinner wall as part of the overall design. The notched joint 54 shown unassembled in FIG. 8 is more suitable for uncoated ball 50 which has a thin walled shell comprised of two halves 52 & 53, having a thickness 56 less than 0.075 inch (1.91 mm). Although not as secure as the beveled joint 29 shown in FIGS. 2–5, the notched joint 54 will nonetheless prevent the two halves (52 & 53) from slipping or pulling apart in the absence of a rubber coating. Again, the ball sealer halves 52 and 53, when snapped together form a spherical shell, wherein the ratio of the spherical shell outer radius 54 to the spherical shell thickness 56 is less than 10.

In all embodiments, adjustments to ball sealer density can be made by varying the wall thickness of the ball sealer. Appendix A contains equations for estimating the allowable uniform external pressure and the density of a ball sealer as a function of material yield stress, material density, and ball dimensions. These equations can be used for all embodiments of the inventive ball sealer. A convenient way to calculate these values is to create templates using computer programs. For example, Tables 1 and 2 show examples of worksheet templates used to assist in the specification of a ball sealer design. In the first example (Table 1), the specific gravity of an uncoated thermoplastic (PEEK) ball sealer 20 (as illustrated in FIGS. 1–5) is shown varying as a function of wall thickness 23. In this case, the inner ball diameter 26 remains fixed to allow use of a common tool size (e.g., ⅝" bit) to bore out the spherical shell 21 of ball sealer 20. Use of a common tool size will reduce manufacturing costs. In the second example (Table 2), ball sealer specific gravity (or density) is shown as a function of wall thickness 34 for a rubber coated 35 aluminum ball sealer 30 (as illustrated in FIGS. 6 & 7A & 7C). In this case, the outer diameter 38 of the coated ball sealer 30 and the outer diameter 37 of the aluminum spherical shell 31 remain fixed to allow use of a common mold size (⅞-inch; 2.22 cm) and to maintain a constant coating 35 thickness independent of the aluminum core 31 wall thickness 34. In both instances, the estimated pressure rating will depend on the yield stress of the material. The yield stress (preferably the compressive yield stress) used to calculate the pressure rating should equal a value attainable at the specified maximum temperature.

The following is an example of the use of Table 1: Assuming that an uncoated thermoplastic ball sealer 20 with a specific gravity of 1.05 is desired for a well stimulation treatment using 15% HCl acid (specific gravity=1.07). Based on the results of Table 1, the ball sealer 20 would require a spherical shell 21 wall thickness 23 of 0.184 inches. Because the spherical shell 21 inner diameter 26 is fixed at 0.625 inches, the resulting outer diameter 24 of the assembled ball sealer 20 would equal 0.992 inches, nominally a 1-inch ball sealer 20. The estimated hydrostatic pressure rating using this particular type of thermoplastic is 18 ksi. A ball sealer should undergo testing at the relevant well temperatures and pressures to confirm this estimate. Manufacturing of this ball sealer 20 design would require a 1-inch bar stock and a ⅝-inch bit to form the two halves (25 & 27) which will be assembled to form spherical shell 21. Additional machining would be required to create the joint 29.

One important benefit of the inventive ball sealer embodiments described herein is that ball sealer density can, if necessary, be increased after manufacturing by placing a solid material like sand or ball beatings between the ball halves before snapping them together. Also, since ball sealer 20 is not coated, it can be taken apart after its initial assembly, then filled with a filler material, and finally reassembled. Thus, in ail embodiments ball sealer density can be varied as needed with respect to the density of the treating fluid to maximize seating and thus sealing effectiveness. To ensure that at least a portion of the ball sealers will seat on the perforations, the ball sealer density should be slightly less than that of the treating fluid at bottomhole conditions. Treating fluids generally have densities ranging from approximately 0.7 grams per cubic centimeter (g/cc) to 1.5 g/cc or above, usually in the range of 0.8–1.3 g/cc, and, for acidic fluids, preferably in the range of 1.0–1.2 g/cc. Thus, as previously noted, the ball density will preferably be 0.02 gm/cc less than the treating fluid. Determinations of optimum ball sealer density can be made by methods and calculations known to those skilled in the art. Also, in all embodiments, adjustments to ball density (specific gravity) can also occur by changing the spherical shell wall thickness, provided that the ratio of the spherical shell outer radius to the spherical shell thickness is less than 10 and provided that the particular joint used will be able to keep the ball sealer from slipping apart. The various embodiments of the ball sealer described herein should not be limited to use with only the joint designs described. Various alternatives and modifications (e.g., screw joint) to the joint designs illustrated herein will be apparent to those skilled in the art without departing from the true scope of the invention as defined in the claims.

BEST MODE

Referring back again to FIGS. 2–5, the best known mode for practicing this invention is to use a high performance thermoplastic made by Hoechst-Celanese called Celazole U-60,™ a material made from polybenzimidazole (PBI). This material has a tensile strength of 23,000 psi (160 MPa), a flexural strength of 32,000 psi (218 MPa), a compressive strength of 50,000 psi (340 MPa), and a specific gravity of 1.3. Common workover fluids such as hydrochloric acid, hydrofluoric acid, and xylene have a nominal effect on the performance properties of this material at elevated temperatures and pressures during a 24-hr period. In a preferred embodiment, the ball sealer 20 is assembled using a beveled joint 29 design as shown in FIG. 2–5. No cover is required to protect the ball sealer 20 or to keep the ball halves (25 & 27) together. For example, a ball sealer 20 made of PBI with a 9/16-inch (1.43 cm) inner diameter 26 and a 0.155-inch (3.94 mm) wall thickness 23 will result in a ⅞-inch (2.22 cm) nominal diameter 24 ball sealer 20 with a specific gravity of 0.95.

With respect to this example, the beveled joint 29 is comprised of a female joint half 1 (FIGS. 4A & 4B) and a male joint half 6 (FIGS. 5A & 5B). The female ball half 27 and the male ball half 25 each have an outer ball radius 22 equal to 0.431 inches. The female joint half 1 also has the following dimensions: lip diameter 102=0.7120"; inner bevel diameter 101=0.7080"; outer bevel diameter 103=0.7275"; angle 104=18 degrees; total joint width 105=0.060"; and female lip width 106=0.030". The reference distance 116 equals 0.461". The male joint half 6 has the following dimensions: lip diameter 91=0.7120"; outer bevel diameter 92=0.7275"; inner bevel diameter 90=0.7080"; angle 93=18 degrees; total joint width 97=0.060"; male lip width 96=0.030". The reference distance 115 equals 0.461".

As described further below, laboratory results using the testing apparatus 60 shown in FIG. 9 reveal that the ⅞-inch nominal diameter 24 PBI ball sealer 20 described above can resist 20,000 psi (137 MPa) hydrostatic pressures at 400° F. (204° C.) for 24 hours with less than a 9% change in density. Additional testing revealed that this PBI ball sealer 20 is capable of withstanding pressures up to 29,000 psi (200 MPa) for about 15 minutes. Increasing the specific gravity of this ball sealer 20 above 0.95 simply requires placement of a solid material (such as sand or steel ball bearings) between the ball halves (25 &27) prior to assembly.

TABLE 1

BALL SEALER WORKSHEET: UNCOATED BALL (20)

Use: For hollow core, solid wall, uncoated ball sealers (20) that use a common tool size to core out the spherical shell (21).
Fixed: Inner diameter (26) of the spherical shell (21).
Variable: Spherical shell (21) wall thickness (23).

| Input Parameters | | Comments |
|---|---|---|
| Yield Stress of Ball Sealer (20) Material (ksi): | 36 | PEEK |
| Specific Gravity of Ball Sealer (20) Material: | 1.4 | |
| Inner Diameter 26 of Spherical Shell (21) (in.): | 0.625 | 5/8" bit |
| Minimum Specific Gravity: | 0.85 | |
| Specific Gravity Increment: | 0.01 | |

UNCOATED BALL

| Specific Gravity | Outer Diameter (24)(in.) | Wall Thickness (23)(in. ×1000)[1] | Estimated Pressure Rating (ksi)[2] |
|---|---|---|---|
| 0.85 | 0.853 | 114 | 14.6 |
| 0.86 | 0.859 | 117 | 14.7 |
| 0.87 | 0.864 | 119 | 14.9 |
| 0.88 | 0.869 | 122 | 15.1 |
| 0.89 | 0.875 | 125 | 15.3 |
| 0.90 | 0.881 | 128 | 15.4 |
| 0.91 | 0.887 | 131 | 15.6 |
| 0.92 | 0.893 | 134 | 15.8 |
| 0.93 | 0.899 | 137 | 15.9 |
| 0.94 | 0.906 | 140 | 16.1 |
| 0.95 | 0.912 | 144 | 16.3 |
| 0.96 | 0.919 | 147 | 16.5 |
| 0.97 | 0.926 | 151 | 16.6 |
| 0.98 | 0.934 | 154 | 16.8 |
| 0.99 | 0.941 | 158 | 17.0 |
| 1.00 | 0.949 | 162 | 17.1 |
| 1.01 | 0.957 | 166 | 17.3 |
| 1.02 | 0.965 | 170 | 17.5 |
| 1.03 | 0.974 | 174 | 17.7 |
| 1.04 | 0.983 | 179 | 17.8 |
| 1.05 | 0.992 | 184 | 18.0 |
| 1.06 | 1.002 | 188 | 18.2 |
| 1.07 | 1.012 | 193 | 18.3 |
| 1.08 | 1.022 | 199 | 18.5 |
| 1.09 | 1.033 | 204 | 18.7 |
| 1.10 | 1.044 | 210 | 18.9 |
| 1.11 | 1.056 | 216 | 19.0 |
| 1.12 | 1.069 | 222 | 19.2 |
| 1.13 | 1.082 | 228 | 19.4 |
| 1.14 | 1.095 | 235 | 19.5 |
| 1.15 | 1.110 | 242 | 19.7 |

[1]Measured in thousands of an inch
[2]Rating will depend on temperature and time; recommend testing prior to use.

TABLE 2

BALL SEALER WORKSHEET: COATED BALL (30)

Use: For hollow core, solid wall, coated ball sealer (30) that use an uncommon tool size to core out the spherical shell (31).
Fixed: Outer diameter (39) of spherical shell (31); coating (35) thickness (34); outer diameter (38) of coated ball sealer (30).
Variable: Wall thickness (34); inner diameter[4] of spherical shell (31).

| Input Parameters | | Comments |
|---|---|---|
| Yield Stress of Ball Sealer (30) Material (ksi): | 73 | 7075-T6 Aluminum |
| Specific Gravity of Ball Sealer (30) Material: | 2.7 | |
| Specific Gravity of Coating (35) Material: | 1.2 | Ethylene-propylene rubber |

TABLE 2-continued

| | | |
|---|---|---|
| Outer Diameter 37 of Spherical Shell (31) (in., cm): | 0.8125 | 13/16" |
| Outer Diameter 38 of Coated Ball Sealer (30) (in.): | 0.875 | 7/8" diameter mold |
| Minimum Wall Thickness (34) (in. ×1000[5]): | 44 | 0.044" with r/t = 9.2 < 10 |
| Wall Thickness (34) Increment (in.): | 1 | 0.001" |

| SPHERICAL SHELL (31) | | | | COATED (35) BALL SEALER (30) | |
|---|---|---|---|---|---|
| Wall Thickness (34) (in ×1000)[5] | Inner Diameter[4] (in.) | Specific Gravity | Estimated Pressure Rating (ksi)[1] | Coating (35) Thickness 34[2] (in ×1000)[5] | Specific Gravity[3] |
| 44 | 0.725 | 0.79 | 14.2 | 31.3 | 0.88 |
| 45 | 0.723 | 0.80 | 14.4 | 31.3 | 0.89 |
| 46 | 0.721 | 0.82 | 14.7 | 31.3 | 0.90 |
| 47 | 0.719 | 0.83 | 15.0 | 31.3 | 0.92 |
| 48 | 0.717 | 0.85 | 15.3 | 31.3 | 0.93 |
| 49 | 0.715 | 0.86 | 15.6 | 31.3 | 0.94 |
| 50 | 0.713 | 0.88 | 15.8 | 31.3 | 0.95 |
| 51 | 0.711 | 0.89 | 16.1 | 31.3 | 0.97 |
| 52 | 0.709 | 0.91 | 16.4 | 31.3 | 0.98 |
| 53 | 0.707 | 0.92 | 16.7 | 31.3 | 0.99 |
| 54 | 0.705 | 0.94 | 16.9 | 31.3 | 1.00 |
| 55 | 0.703 | 0.95 | 17.2 | 31.3 | 1.01 |
| 56 | 0.701 | 0.97 | 17.5 | 31.3 | 1.03 |
| 57 | 0.699 | 0.98 | 17.7 | 31.3 | 1.04 |
| 58 | 0.697 | 1.00 | 18.0 | 31.3 | 1.05 |
| 59 | 0.695 | 1.01 | 18.3 | 31.3 | 1.06 |
| 60 | 0.693 | 1.03 | 18.5 | 31.3 | 1.07 |
| 61 | 0.691 | 1.04 | 18.8 | 31.3 | 1.08 |
| 62 | 0.689 | 1.06 | 19.1 | 31.3 | 1.10 |
| 63 | 0.687 | 1.07 | 19.3 | 31.3 | 1.11 |
| 64 | 0.685 | 1.09 | 19.6 | 31.3 | 1.12 |
| 65 | 0.683 | 1.10 | 19.8 | 31.3 | 1.13 |
| 66 | 0.681 | 1.11 | 20.1 | 31.3 | 1.14 |
| 67 | 0.679 | 1.13 | 20.3 | 31.3 | 1.15 |
| 68 | 0.677 | 1.14 | 20.6 | 31.3 | 1.16 |
| 69 | 0.675 | 1.16 | 20.8 | 31.3 | 1.17 |
| 70 | 0.673 | 1.17 | 21.1 | 31.3 | 1.19 |
| 71 | 0.671 | 1.18 | 21.3 | 31.3 | 1.20 |
| 72 | 0.669 | 1.20 | 21.6 | 31.3 | 1.21 |
| 73 | 0.667 | 1.21 | 21.8 | 31.3 | 1.22 |
| 74 | 0.665 | 1.22 | 22.0 | 31.3 | 1.23 |

[1]Rating will depend on temperature and time; recommend testing prior to use.
[2]Recommend a minimum coating thickness of 0.03 inches.
[3]0.01 gm/cc added to account for adhesive used during coating process.
[4]Outer Diameter 37 minus wall thickness 34.
[5]Measured in thousands of an inch.

LABORATORY EXAMPLES

Figure 9:
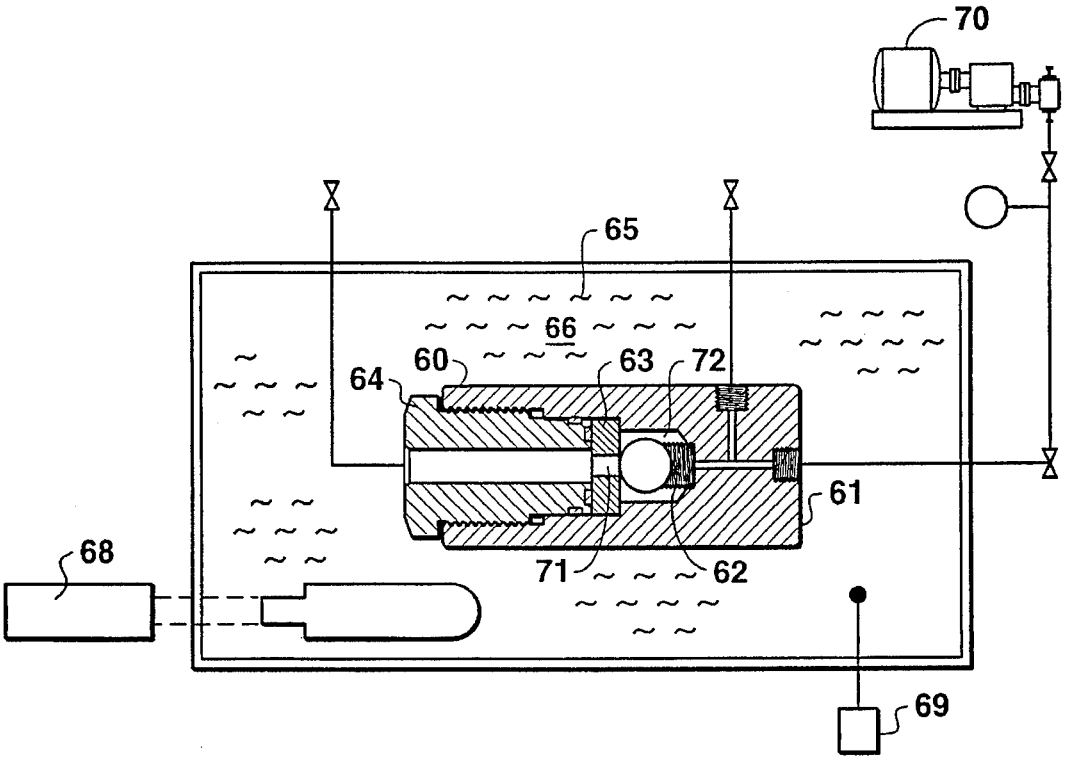
FIG. 9 is an illustration of the laboratory apparatus used in testing various embodiments of the inventive ball sealer for resistance to pressure and temperature.

A series of laboratory tests were performed using the testing apparatus 60 shown in FIG. 9 to determine the pressure and temperature ratings of various embodiments of the inventive ball sealer when seated across a simulated perforation 71. The apparatus 60 is comprised of a housing 61, a set spring 62, a perforated disk 63, a cap 64, a bath 65 filled with heating oil 66, a cover 67, a heater 68, a temperature controller 69, and a hydrostatic pump 70.

To perform the tests, a ball sealer is placed inside the cell 72 against the set spring 62. After placing the perforated disk 63 against the ball sealer, the cap 64 is fastened to the housing 61. The set spring 62 keeps the ball sealer seated against the perforation 71 after tightening the cap 64. Seals inside the cell 72 prevent leaks from forming during a test. After filling the cell 72 with water, hydrostatic flow lines (not shown) are connected from the pump 70 to the cell 72. The cell 72 is then submerged inside the bath 65 containing silicone fluid 66 and covered. The heater 68 increases and stabilizes bath 65 temperatures at a certain level. Finally, hydrostatic pressure is applied to the ball sealer. The flow lines are configured to allow application of both hydrostatic pressures and differential pressures across the perforation 71. After the heating oil 66 reaches a certain temperature, hydrostatic pressure is applied to the ball sealer using the pump 70 and valves controlling the hydrostatic flow lines.

Once hydrostatic pressures reached a predetermined value, valves were closed and pressures monitored to see if changes occurred over time. Pressure readings were taken for up to 24 hours. Afterwards, the bath 65 was cooled, then the apparatus 60 was removed. The cap 64 was unfastened from the housing 61 and the ball sealer was removed and visually inspected for deformation and wear, then the density of the ball sealer was determined using liquid standards. Data from the these tests allowed a determination of the pressure rating for a given ball sealer at temperatures similar to bottom hole temperatures that occur during a stimulation treatment of a well.

Figure 10:
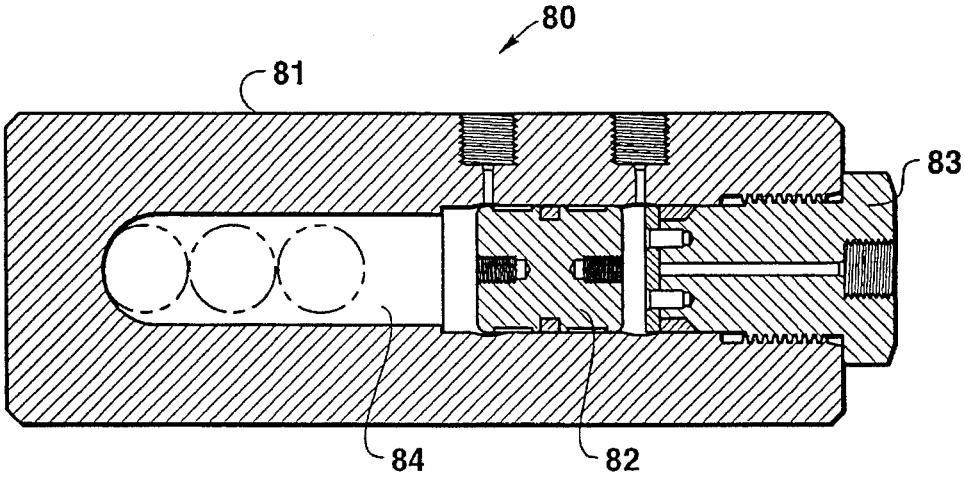
FIG. 10 is an illustration of the laboratory apparatus used in testing various embodiments of the inventive ball sealer for resistance to various fluids.

The apparatus 80 shown in FIG. 10 was used to determine the environmental resistance of a ball sealer when exposed to solvents at high pressures and temperatures. Similar to the test apparatus shown in FIG. 9, this apparatus 80 is comprised of a housing 81, a piston seal assembly 82, a cap 83, a bath filled with heating oil, a cover, a heater, a temperature controller, and a hydrostatic pump (all not shown). To perform the testing, from one to three ball sealers are placed inside a housing 81 made from a high grade alloy designed to withstand the degrading effects of solvents at high temperatures and pressures. The cell 84 is filled with a solvent, then the piston seal assembly 82 is inserted into the cell 84. This seal assembly 82 prevents solvent from leaking into the flow lines or the bath. After fastening the cap 83 to the housing 84, hydrostatic flow lines (not shown) are connected and the cell 84 is submerged inside the bath containing silicon fluid and then covered. After the heater increases and stabilizes bath temperatures at a certain level, hydrostatic pressure is applied. After a certain time period, the bath 65 is cooled, then the apparatus 80 is removed. The cap 83 and the piston seal assembly 82 are removed from the housing 81. Ball sealers are then recovered from the cell 84 and are visually inspected for material, including cover, degradation. Data from these tests allowed for a determination of the environmental resistance of a given ball sealer.

Table 3, set forth below, summarizes the results of tests on ball sealers 20 (FIGS. 2–5) made from several high performance thermoplastics. The thermoplastic materials used were polybenzimidazole (PBI), fiber and glass-filled polyetheretherkeotone (PEEK), and TORLON(R), a polyamide-imide. Ball sealer 20 densities varied from 0.95 to 1.15 gm/cc. Nominal ball diameters 24 were 0.875 inch (2.22 cm). These groups of ball sealers 10 did not require a protective coating because of the high environmental ratings of the thermoplastic materials.

Test results show that the PBI ball sealers 20 are capable of withstanding hydrostatic pressures up to 20,000 psi (137 MPa) at 400° F. (204° C.) for 24 hours with less than a 10% change in density. The PEEK ball sealers 20 used during these tests, however, did not perform satisfactorily when exposed to high temperatures and pressures. Analysis following testing of the carbon-fiber reinforced PEEK ball sealer 10 revealed that flaws existed in the material matrix within the spherical shell 21 wall of the ball sealers 20. Hence, the carbon-fiber reinforced PEEK material may be suitable for use in hostile well environments if proper steps are taken to ensure that no flaws exist within the material matrix prior to ball sealer 20 manufacturing. The glass-filled PEEK ball sealers 20 also weakened considerably with increasing temperatures. This material proved unsuitable for use as a ball sealer for temperature applications above about 275° F., but may be useful for temperatures at or below 275° F.

Test results indicate that the TORLON ball sealers 20 are capable of withstanding 16,000 psi (110 MPa) at 325° F. (163° C.) for 24 hours. These ball sealers 20 underwent nominal degradation when exposed to mud acid (12% HCl+3% HF) or to xylene. Severe degradation occurred, however, when the TORLON ball sealers 20 were exposed to high concentrations of hydrochloric acid (28% HCl) at high pressures and temperatures. From this result, it is believed that TORLON would not serve as a suitable material for ball sealers 20 when diverting workover fluids containing high concentrations of hydrochloric acid.

TABLE 3

Hollow-Core, Solid Wall, High-Performance Thermoplastic Ball Sealers (20)

| Ball Material & Size (in; gm/cc) | Ball Num. | Temp (°F.) | Pres. (ksi) | Time (hr) | Test Fluid | Comments[8&9] |
|---|---|---|---|---|---|---|
| | 1 | 375 | 14 | 48 | Water | OK; increased to 24 ksi, OK |
| PBI[3] | 2 | 400 | 20 | 48 | Water | OK; SG –> 1.10 |
| | 3 | 400 | 20 | 24 | Water | OK; SG –> 1.03 |
| 0.155 wall thickness (23) | 4 | 370 | 17 | 24 | Water | OK; 6.5 ksi differ.; SG –> 1.06 |
| | 5 | 300 | 12 | 18 | HCl[1] | OK; SG unchanged |
| SG[7] = 0.95 | 6 | 300 | 10 | 24 | HCl/HF[2] | OK |
| | 7 | 300 | 10 | 19 | Xylene | OK |
| | 1 | 375 | 16 | 1–2 | Water | Failed as temp. incr. to 400° F. |
| Carbon-filled PEEK[4] | 2 | 375 | 14 | 12 | Water | Failed overnight |
| | 3 | 350 | 17 | 6 | Water | Failed overnight |
| 0.150 wall thickness (23) | 4 | 325 | 17 | <1 | Water | Failed |
| | 5 | 325 | 14.5 | <1 | Water | Failed while pressuring-up |
| SG[7] = 1.02 | 6 | 325 | 14 | <1 | Water | Failed while pressuring-up |
| | 7 | 300 | 10 | 24 | HCl[1] | OK |
| Glass-filled PEEK[5] | 1 | 325 | 9.5 | <1 | Water | Failed while pressuring-up |
| 0.140 wall thickness (23) | 2 | 300 | 11.5 | <1 | Water | Failed while pressuring-up |
| SG[7] = 1.00 | 3 | 275 | 12 | 2 | Xylene | Failed |
| | 1 | 350 | 15 | <1 | Water | Failed |
| TORLON (R)[6] | 2 | 325 | 15 | 22 | Water | OK |
| | 3 | 325 | 16 | 24 | Water | OK; incr. to 19 ksi, failed. |
| 0.150 wall thickness (23) | 4 | 300 | 10 | 24 | HCl[1] | Failed; severe mat'l degrad. |
| | 5 | 300 | 10 | 24 | HCl/HF[2] | OK; nominal degradation |
| SG[7] = 1.15 | 6 | 300 | 10 | 19 | Cylene | OK |

[1]HCl @ 28% concentration
[2]HCl/HF = 12% HCl + 3% HF

TABLE 3-continued

[2]PBI: polybenzimidazole; inner diameter (26) of ball sealer (20) = 0.5625 inches (1.43 cm); outer diameter (27) = 0.872 inches (2.21 cm).
[4]Carbon-filled PEEK (polyetheretherketone): inner diameter (26) of ball sealer (20) = 0.5625 inches (1.43 cm); outer diameter (27) = 0.862 inches (2.10 cm).
[5]Glass-filled PEEK: inner diameter (26) of ball sealer (20) '2 0.625 inches (1.59 cm); outer diameter (27) = 0.905 inches (2.30 cm).
[6]TORLON (R): (polyamide-imide); inner diameter (26) of ball sealer (20) = 0.575 inches (1.46 cm); outer diameter (27) = 0.875 inches (2.22 cm).
[7]SG: Specific Gravity.
[8]"Failed" indicates that the spherical shell (21) collapsed or buckled.
[9]"OK" indicates that the spherical shell (21) did not collapse and maintained its seal.

Table 4 summarizes the results of laboratory tests on uncoated and coated 35 ball sealers 30 made from high strength aluminum (7075-T6) and having a straight joint 36. Ball sealer 30 densities varied as a function of wall thickness 34. The first group of ball sealers (Group A) underwent short term testing (1 hour) to determine resistance to differential pressures when seated across a simulated perforation (FIG. 9). These tests occurred at ambient and at elevated temperatures. As shown in Table 4, the high strength aluminum ball sealers 30 validated the concept of using hollow-core, solid wall designs to withstand high differential and hydrostatic pressures for short periods of time at ambient and at elevated temperatures. The ball sealers 30 remained intact after testing and provided a tight seal across the simulated perforation 71 (FIG. 9), thus preventing fluid from flowing through the perforation 71.

Next, the effects of temperature and of wall thickness 34 on pressure ratings were determined by conducting tests on several other ball sealers (Groups B–G, in Table 4). The first few ball sealers in each Group were uncovered and underwent testing at different temperatures during a 24-hour period to establish performance ratings. Following these tests, some of the ball sealers 30 were covered 35 with a Buna-N rubber then tested at the previously established ratings. Finally, the remainder of the ball sealers 30 were covered 35 with ethylene-propylene and tested again at the previously established ratings. The test results as shown in Table 4 indicate that the high-strength aluminum ball sealers 30 are capable of withstanding hydrostatic pressures ranging from 12,000 to 17,000 psi (82 to 116 MPa) for wall thicknesses 34 ranging from 0.052 to 0.065 inches (1.32 to 1.65 mm) during a 24-hr period. For this range of wall thicknesses 34 the specific gravities (densities) ranged from 1.04 to 1.15. The optimal working temperature is 300° F. (149° C.). Though equivalent pressure ratings are possible at higher temperatures, failure times begin to fall below 24 hours (in one case failure occurred in less than one hour at 350° F.). Indications are that the maximum working temperature for this particular grade of high-strength aluminum (7075-T6) is 325° F. (163° C.). Though swelling occurred, the Buna-N rubber coating 35 managed to remain intact and protect the aluminum spherical shell 31 of the ball sealer 30 when exposed to mud acid (HCl/HF) and to xylene at high temperatures and pressures. This coating 35, however, did not perform satisfactorily when exposed to high concentrations of HCl (28%). The ethyleneopropylene coating 35 underwent nominal degradation when exposed to HCl, HCl/HF, and xylene at high temperatures and pressures. Under these conditions the ethylene-propylene rubber coating 35 appears more durable when compared to the Buna-N rubber.

TABLE 4

| | Hollow-Core, Solid Wall, High-Strength Aluminum Ball Sealers (30) | | | | | | |
|---|---|---|---|---|---|---|---|
| Ball Size (in; gm/cc) | Ball Num. | Temp (°F.) | Pres (ksi) | Time (hr) | Test Fluid | Cover Type | Comments[4,5&6] |
| GROUP A | 1 | 72 | 20 | 1 | Water | None | Differential pres. only; OK |
| 0.960 O.D. (38) 0.075 wall thickness (34) | 2 | 72 | 25 | 1 | Water | None | Differential pres. only; OK |
| 0.810 I.D. (37) | 3 | 72 | 30 | 1 | Water | None | Differential pres. only; OK |
| SG[3] = 1.08 | 4 | 420 | 30 | 1 | Water | None | 6 ksi diff. pres. applied; OK |
| GROUP B | 1 | 325 | 12 | 24 | Water | None | OK |
| | 2 | 325 | 12 | 22 | Water | None | Failed |
| 0.875 O.D. (38) | 3 | 300 | 12 | 16 | Water | None | OK |
| | 4 | 300 | 12 | 24 | Water | Buna-N | OK |
| 0.052 wall thickness (34) | 5 | 300 | 12 | 18 | HCl[1] | Buna-N | Cover (35) swelled; Spherical Shell (31) OK |
| 0.6875 I.D. (37) | 6 | 300 | 12 | 22 | Xylene | Buna-N | Cover (35) swelled, split; Spherical Shell (31) OK |
| SG[3] = 1.04 | 7 | 300 | 10 | 24 | HCl[1] | EthyProp. | Nom. cover (35) degrad.; Spherical Shell (31) OK |
| | 8 | 300 | 10 | 24 | HCl/HF[2] | EthyProp. | Cover (35) OK; Spherical Shell (31) failed |

TABLE 4-continued

| Ball Size (in; gm/cc) | Ball Num. | Temp (°F.) | Pres (ksi) | Time (hr) | Test Fluid | Cover Type | Comments[4,5&6] |
|---|---|---|---|---|---|---|---|
| | Hollow-Core, Solid Wall, High-Strength Aluminum Ball Sealers (30) | | | | | | |
| | 9 | 300 | 10 | 19 | Xylene | EthyProp. | Cover (35) swelled, intact; Spherical Shell (31) OK |
| GROUP C | 1 | 325 | 19 | <1 | Water | None | Failed |
| | 2 | 325 | 14 | 8 | Water | None | Failed overnight |
| 0.875 O.D. (38) | 3 | 325 | 13 | 24 | Water | None | OK |
| | 4 | 325 | 13 | 24 | Water | Buna-N | OK |
| thickness (34) | | | | | | | |
| 0.6785 I.D. (37) | 6 | 300 | 12 | 18 | HCl[1] | Buna-N | Cover (35) split; Spherical Shell (31) dissolved |
| SG[3] = 1.06 | 7 | 300 | 12 | 22 | Xylene | Buna-N | Cover (35) swelled, split; Spherical Shell (31) OK |
| GROUP D | 1 | 335 | 15 | 12 | Water | None | Failed |
| | 2 | 325 | 17 | 6 | Water | None | Failed |
| 0.875 O.D. (38) | 3 | 325 | 16 | 24 | Water | None | OK |
| | 4 | 325 | 16 | 24 | Water | None | OK |
| 0.058 wall thickness (34) | 5 | 325 | 15 | 8 | Water | None | Failed overnight |
| | 6 | 300 | 15 | 24 | Water | None | OK |
| 0.6875 I.D. (37) | 7 | 325 | 16 | 8 | Water | Buna-N | Failed overnight |
| | 8 | 300 | 15 | 21 | HCl/HF[2] | Buna-N | Cover (35) swelled; Spherical Shell (31) OK |
| SG[3] = 1.09 | 9 | 300 | 12 | 22 | Xylene | Buna-N | Cover (35) swelled, split; Spherical Shell (31) OK |
| GROUP E | 1 | 325 | 17 | 8 | Water | None | Failed overnight |
| 0.875 O.D. (38) | | | | | | | |
| | 2 | 325 | 17 | 24 | Water | None | OK |
| 0.061 wall thickness (34) | 3 | 300 | 16 | 24 | Water | None | OK |
| 0.6875 I.D. (37) | 4 | 325 | 17 | 8 | Water | Buna-N | Failed overnight |
| SG[3] = 1.11 | 5 | 300 | 15 | 21 | HCl/HF[2] | Buna-N | Cover (35) swelled; Spherical Shell (31) OK |
| GROUP F | 1 | 350 | 18 | 1 | Water | None | Failed |
| | 2 | 350 | 18 | 1 | Water | None | Failed |
| 0.875 O.D. (38) | 3 | 350 | 17 | 4 | Water | None | Failed |
| | 4 | 350 | 16.5 | <1 | Water | None | Failed |
| 0.065 wall thickness (34) | 5 | 325 | 18 | 3 | Water | None | Failed overnight |
| | 6 | 325 | 17 | 8 | Water | None | Failed overnight |
| 0.6875 I.D. (37) | 7 | 325 | 17 | 24 | Water | Buna-N | OK |
| SG[3] = 1.15 | 8 | 300 | 15 | 21 | HCl/HF[2] | Buna-N | Cover (35) swelled; Spherical Shell (31) OK |
| GROUP G | 1 | 300 | 16 | 6 | Water | None | Failed |
| 0.625 O.D. (38) | | | | | | | |
| 0.040 wall thickness (34) | 2 | 300 | 15 | 8 | Water | None | Failed overnight |
| 0.5625 I.D. (37) | 3 | 300 | 14 | 8 | Water | None | Failed overnight |
| SG[3] = 0.90 | 4 | 300 | 13 | 24 | Water | None | OK |

Notes:
[1]HCl @ 28% concentration
[2]HCl/HF = 12% HCl + 3% HF
[3]Ball specific gravity measured with coating.
[4]"Differential Pressure Only" means pressure only on one side of ball.
[5]"Failed" indicates that the spherical shell (21) collapsed or buckled.
[6]"OK" indicates that the spherical shell (21) did not collapse and maintained its seal.

FIELD TESTS

A series of field tests were conducted to evaluate the performance of two embodiments of the inventive hollow-core, thick-walled ball sealer. The first embodiment tested was ball sealer 20, as illustrated in FIGS. 2–5, made of a high-performance thermoplastic and having a beveled joint 29. The second ball sealer embodiment tested was a high-strength aluminum ball sealer 30, as illustrated in FIGS. 6, 7A and 7C, covered 35 with rubber and having a straight joint 36. Table 5 summarizes the results of these field tests.

HIGH-PERFORMANCE THERMOPLASTIC UNCOATED BALL SEALERS 20

As previously mentioned, FIGS. 2 and 3 illustrate, respectively, assembled and unassembled ball sealer 20 of the design type tested. The ball sealers 20 tested were made from a high-performance thermoplastic called polybenzimidazole, or PBI, a material developed by Hoechst-Celanese. The trade name is Celazole U-60™. It has a tensile strength of 23,000 psi (160 MPa), a flexural strength of 32,000 psi (218 MPa), a compressive strength of 50,000 psi (340 MPa), and a specific gravity of 1.3. Common workover fluids such as HCl acid, HF acid, and xylene have a nominal effect on the performance properties of this material at elevated temperatures during a 24 hour period. This material was tested for 24 hours, but it is believed that it can withstand hostile conditions for even longer periods. Thus, with this material, the ball sealers 20 do not require a protective coating because of the good environmental ratings associated with PBI. Since the ball sealer 20 is assembled using a beveled joint design 29, a cover (or coating) is also not required to keep the ball sealer halves (25 & 27) together. Increasing the density (or specific gravity) of the ball sealer 20 above the ball sealet's 20 manufactured density, if necessary, simply requires placement of a solid material between the ball halves (25 & 27) prior to assembly. Note that the original manufactured ball sealer 20 density can still be restored by separating the two halves (25 & 27), removing the solid filler material, then snapping the two halves (25 & 27) back together. The filler material used should be a solid, chemically inert material like sand or steel ball bearings. This PBI ball sealer 20 design underwent field testing inside wells located in Oklahoma and Texas.

Field tests using PBI ball sealers 20 first occurred in three gas producing wells (Wells A, B, and C) located in Western Oklahoma. The average field depth of these wells is 25,400 ft (7,742 m), with bottomhole temperatures averaging about 385° F. (196° C.). The initial gas production ranged from 18 to 25 MCF/D, with a water production rate of about 7 BW/MCF. These wells also produce $H_2S$ and $CO_2$. The workover plan for Wells A and B involved pumping several hundred barrels of 15% HCl and water at six to eight barrels per minute to remove salt and other scale from the perforation tunnels. The workover plan for Well C also involved pumping 15% HCl and water, but in larger volumes (4259 bbl) and at higher rates (10–22 BPM) to fracture the formation following re-completion of the well. In each case, an overflush comprised of a 50/50 mixture of water and nitrogen followed the last acid stage to avoid overloading the production tubing and killing the well.

PBI ball sealers 20 having an 0.875 in. nominal diameter 24 with an initial specific gravity of 0.95 were manufactured for use during workovers in all three wells. The ball sealers 20 had a 9/16-inch (1.43 cm) inner diameter 26 and a 0.155-inch (3.94 mm) thick wall 23. Laboratory testing using the apparatus shown in FIG. 9 revealed that these ⅞-inch diameter 24 PBI ball sealers 20 could resist 20,000 psi (137 MPa) hydrostatic pressures at 400° F. (204° C.) for 24 hours with less than a 9% change in density. Additional testing revealed that this PBI ball sealers 10 were capable of withstanding differential pressures across the perforations up to 6,500 psi (45 MPa) for 24 hours at 370° F. (188° C.).

Initially, there was a concern with the potential for damage to surface equipment due to the possibility of the ball sealers 20 returning to the surface after the well resumed production. A ball catcher designed to perform under high pressures and sour service was unavailable to retrieve the ball sealers 20 after completion of the workovers. Thus, a non-buoyant ball sealer 20 was used during workovers in Wells A and B: To meet this requirement, the density of the original 0.95 specific gravity ball sealers 20 was increased to 1.10 gm/cc by placing 0.15 gm of small steel ball bearings inside the core of each ball sealer 20 prior to assembly. As a result, the ball sealers 20 sank to the bottom of the well after they unseated from the perforations once production resumed. However, using a ball sealer 20 which was non-buoyant prevented retrieval and subsequent visual evaluation of any of the ball sealers 20 used. Following workovers in the Wells A and B, it was determined that the chances of the ball sealers 20 returning to the surface were minimal once the ball sealers 20 were exposed to the 50/50 water-nitrogen overflush and the well was slowly returned to production. Thus, a 1.05 specific gravity ball sealer 20 was used for the Well C workover to improve seating efficiencies. These ball sealers 20 remained buoyant while exposed to 15% HCl acid, but became non-buoyant once exposed to the 50/50 water-nitrogen overflush.

As shown in Table 5, the PBI ball sealers 20 performed effectively when measured in terms of ball action observed (which means observed changes in surface treating pressures) during the workovers, or in terms of increased production rates afterwards. For example, gas production of Well B increased from 9.5 to 15.2 Mscf/d at 1,625 psi FFP. Ball action occurred as the 20 PBI ball sealers 20 (15 followed by 5) approached the 33 perforations located between 24,114 ft and 24,714 ft. The estimated maximum bottomhole treating pressure during the workover was 8,100 psi (56 MPa). For Well C the gas production resumed at 12 Mscf/d at 1,500 psi FTP following a recent re-completion of this well. The rate continued to increase over a four day period to 14.5 Mscf/d at 1,600 psi FTP. Ball action also occurred as the 100 PBI ball sealers 20 (25 balls in 4 stages) approached the 154 perforations located between 24,485 ft and 24,751 ft. The estimated maximum bottomhole treating pressure during the workover was 8,400 psi (58 Mpa). Previous stimulation treatments of a similar type in Wells B and C, but without ball sealers 20, had resulted in less build-up in gas production rates. Thus, the ball sealers were apparently effective at redirecting the HCl acid more uniformly across the perforated intervals of Wells B and C.

Regarding Well A, production rates initially did not improve nor was ball action observed. The estimated maximum bottomhole treating pressure was 6,400 psi (44 MPa). A post-job analysis indicated that the decline in production rates was due to the formation of scale comprised of barium sulfate ($BaSO_4$) and pyrite, an iron sulfide, inside the production tubing. An acid soak job occurred a month later to dissolve the iron sulfide and loosen the solids sufficiently to allow scale removal during production of reservoir fluids. Following the acid soak job production rates increased from 5.61 to 8.92 Mscf/d.

A field test using PBI ball sealers 20 also occurred in a gas producing well (Well D) located in South Texas. The well depth is 14,000 ft (4,267 m) with a bottomhole static temperature of 390° F. (199° C.). The workover plan involved pumping 277 bbl of xylene and water at seven to 10 barrels per minute to remove near wellbore damage attributed to drilling mud, followed by an 180,000 lb proppant fracture. There was interest in using a ⅞-inch nominal diameter 24 buoyant ball sealer 20. Indications were that downhole temperatures and pressures during the workover would result in a decrease in xylene density from 0.86 gm/cc to about 0.82 gm/cc. Thus, a PBI ball sealer 20 with a specific gravity of 0.80 was required to ensure that it would remain buoyant during the workover. To meet this requirement, a 0.875 inch (2.22 cm) nominal diameter 24 PBI ball sealer 20 with a specific gravity of 0.80 was manufactured. The ball sealer 20 had a 0.635-inch (1.61 cm) inner diameter 26 and a 0.120-inch (3.05 mm) spherical shell 21 wall thickness 23. As previously discussed, laboratory testing using the apparatus shown in FIG. 9 revealed that this ⅞-inch PBI ball sealer 20 could resist 15,000 psi (103 MPa) hydrostatic pressures at 390° F. (199° C.) for eight hours with nominal change in density.

As shown in Table 5, the PBI ball sealer 20 performed effectively during the Well D workover when measured in terms of gas production rates which increased from 1.2 Mscf/d at 6,900 psi FTP to 2.2 Mscf/d at 8,000 psi FTP. The estimated maximum bottomhole treating pressure during the workover was 8,400 psi (58 MPa). A few days later, the well was fractured using 180,000 lbs of proppant, resulting in a further increase in gas production to 5.0 Mscf/d at 9,175 psi FTP. Sixty PBI ball sealers 20 were pumped downhole and seated across the 72 perforations located between of 13,666 ft and 13,702 ft. Although no ball action was observed during the xylene treatment, nominal changes in tubing pressures were expected since formation damage attributed to drilling mud was believed to be uniform over the interval. A ball catcher was present to retrieve the balls sealers 20 after completion of the workover. A tail pipe below the production packer prevented most of the ball sealers 20 from returning to the surface, but six intact ball sealers 20 and one ball half were recovered. The six intact ball sealers 20 returned in very good shape and underwent no change in density. The orientation of the ball sealers 20 on the perforations during the stimulation treatment was apparent as indicated by changes in surface texture and color of the ball sealers returned. It is believed that the one ball sealer 20 half returned means that an intact ball sealer 20 separated either during the workover or while returning to surface. Since hydrostatic pressures tend to keep a ball sealer 20 together and the specific gravity of a ball sealer 20 half is considerably higher than the stimulation fluid (1.3 versus 1.07), chances are the ball sealer 20 separated near the surface upon return.

HIGH STRENGTH ALUMINUM COATED BALL SEALERS 30

A ball sealer 30, having the joint design 36 as shown in FIG. 6 and 7A–7D, made from a high-strength aluminum known as 7075-T5 will have a yield strength of 73,000 psi (508 MPa) and a specific gravity of 2.7. Since certain stimulation fluids like HCl acid have a detrimental effect on aluminum, a protective coating 35 is required. As previously mentioned, laboratory tests revealed that ethylene-propylene undergoes nominal degradation when exposed to HCl, HCl/HF, or xylene at high temperatures and pressures. Thus, the preferred coating 35, if necessary (e.g., exposure to HCl, HCl/HF) for ball sealers 30 made from high-strength aluminum is ethylene-propylene. One disadvantage of the ball sealer 30 is that adjustments to ball density cannot occur following application of the coating material, unlike the joint 29 illustrated in FIGS. 2–5, which does not need a coating. Joint 36 is, however, less expensive to manufacture when compared to the joint 29.

As previously mentioned, laboratory results revealed that 0.875 inch (2.22 cm) nominal diameter 38 ball sealers 30 made from 7075-T6 high-strength aluminum are capable of withstanding hydrostatic pressures ranging from 12,000 to 17,000 psi (82 to 116 MPa) at temperatures ranging from 300° F. to 325° F. (149° to 163° C.) during a 24 hour period. Spherical shell 31 wall thicknesses 34 ranged from 0.052 to 0.065 inches (1.32 to 1.65 mm), with specific gravities ranging from 1.04 to 1.15. For example, an aluminum ball sealer 30 with a 13/16-inch (2.06 cm) spherical shell 31 outer diameter 37, a 0.055-inch (1.4 mm) thick wall 34, and a 0.031-inch (0.79 mm) thick rubber coating 35 will result in a ⅞-inch (2.22 cm) nominal diameter 38 ball sealer 30 with a specific gravity of about 1.06. Laboratory tests reveal that this ⅞-inch nominal diameter 38, rubber-coated 35 aluminum ball sealer 30 can resist 13,000 psi (89 MPa) hydrostatic pressures at 300° F. (149° C.) for 24 hours with nominal (less than 5%) change in density. Higher pressure ratings were attainable for shorter time periods. The yield strength of 7075-T6 aluminum decreases notably, however, with increasing temperatures. Thus, when using 7075-T6 as a material for a hollow core, thick-walled ball sealer 30, indications are that the maximum working temperature for this particular grade of high-strength aluminum is 300° F. The aluminum ball sealer 30 underwent field testing inside wells located in Texas (Well E) and in Wyoming (Well F).

A field test using aluminum ball sealers 30 occurred in Well E in East Texas, which is a 11,895 ft (3,626 m) deep gas well with a bottomhole static temperature of 280° F. (138° C.). The workover plan involved pumping 850 bbl of gelled, 15% HCl acid (40 lb/1000 gal) at 10 barrels per minute to fracture the well. As described above, a ⅞-inch nominal ball diameter 38, ethylene-propylene coated 35, high-strength aluminum ball sealer 30 with a specific gravity of 1.05 was manufactured for use during the workover. Additional laboratory tests using the testing apparatus shown in FIG. 9, as described above, revealed that this ⅞-inch nominal diameter 38 aluminum ball sealer 30 could resist 10,000 psi (103 MPa) hydrostatic pressures at 280° F. (199° C.) for 24 hours with nominal change in density. The ball sealer 30 failed after increasing the pressure to 21,000 psi (216 MPa). As shown in Table 5, the aluminum ball sealer 30 performed effectively when measured in terms of observed ball action as indicated by changes in surface treating pressures. A cross-linked 40# gel was also pumped ahead of the acid and balls. This gel may have entered and plugged the formation, and thus contributed to the increases in tubing pressure. A total of 120 high-strength aluminum ball sealers 30 (40 ball sealers 30 in 3 stages) were pumped across the 170 perforations located between 11,452 ft and 11,582 ft. Following the workover, Well E began producing 4.5 Mscf/d at 2900 psi FTP. The estimated maximum bottomhole treating pressure during the workover was 5,400 psi (37 MPa).

A ball catcher was installed to retrieve the ball sealers 30 after completion of the Well E workover. Though a tail pipe below the production packer prevented most of the ball sealers 30 from returning to the surface, 27 of 120 ball sealers 30 were recovered. Seven of the 27 ball sealers 30 returned intact, with a fine sandy residue covering the outer rubber coatings 35. Of the remaining 20 ball sealers 30, the outer covers 35 underwent considerable degradation, but note that the aluminum spherical shells 31 remained essentially intact. Interestingly, unlike the other seven ball sealers 30, the degraded covers 35 of these 20 ball sealers 30 had nominal residue on the surface. One possible explanation for why these covers 35 underwent extensive degradation while the spherical shells 31 remained essentially intact is that removal of the cover 35 and of the sandy residue occurred at the surface inside the ball catcher. Since these ball sealers 30 were buoyant by design, perhaps they continued to rise inside the ball catcher, to reappear in the flow stream, and to rub against the deflector grid. Such repetitive actions could result in eventual removal of the sandy residue and in circumferential erosion of the rubber coating 35 from the spherical shell 31 surface. Nonetheless, the spherical shells 31 of all 27 ball sealers 30 remained intact and apparently performed satisfactorily during the workover.

A field test using aluminum ball sealers 30 also occurred in a Well F located in Wyoming. Well F is a 15,279 ft (4,657 m) deep gas well with a bottomhole static temperature of 280° F. (138° C.). The workover plan involved pumping 1,210 bbl of 15% HCl at 12 to 14 barrels per minute to matrix acidize the formation. The same ⅞-inch nominal diameter 38, ethylene-propylene coated 35, high-strength aluminum, 1.05 specific gravity ball sealer 30 used during the workover of Well E was also used during the Well F workover. As shown in Table 5, the high-strength aluminum ball sealers 30 performed effectively when measured in terms of observed ball action during the workover and in terms of increased production rates afterward. A total of 150 aluminum ball sealers 30 were pumped across the 249 perforations located between 14,365 ft and 15,136 ft. Following the workover, the gas production rate of Well F increased from 34 Mscf/d at 2,000 psi FTP to 55 Mscf/d at 2040 psi FTP. Some ball action was observed during the matrix acidizing treatment. To observe ball action during the workover was unexpected, given the number of perforations present. The estimated maximum bottomhole treating pressure during the workover was 7,000 psi (47 MPa). Even though a ball catcher was present to retrieve the ball sealers 30 after completion of the workover, no ball sealers were recovered from Well F. This outcome was expected, however, since the ball sealers 30 most likely sank to the well bottom once exposed to the fresh water afterflush.

TABLE 5

FIELD TEST RESULTS OF BALL SEALERS DESIGNED FOR HOSTILE WELL ENVIRONMENTS

| Well; Location; and Date | Perf Interval (ft) | BHST (°F.) | Fluids | Total Volume and Rate | No. of Perfs and Balls | BHP[1] (ksi) | Production Rates Before and After | Ball Action | Comments |
|---|---|---|---|---|---|---|---|---|---|
| Wella A Oklahoma 10/27/93 | 24,763 to 24,998 | 375[2] | 15% Hcl and Water | 654 bbl 6–8 bpm | 26 perfs 10 PBI Ball Sealers (20) 1.10 SG | 6.4 | 7.7 Mscf/d @ 1500 psi FTP 7.5 Mscf/d @ 1140 psi FTP | No | Rate dropped to 5.61 Mscf/d on 10/27/93; post-job analysis indicated BaSO4 and pyrite scale in tubing; and acid soak job occurred on 11/23/93 to removed scale; rate improved from 5.61 to 8.92 Mscf/d. |
| Well B Oklahoma 3/25/94 | 24,114 to 24,714 | 375[2] | 15% HCl and Water | 1,028 bbl 6 bpm[3] | 33 perfs 20 PBI Ball Sealers (20) 1.10 SG | 8.1 | 9.5 Mscf/d[4] 15.2 Mscf/d @ 1625 psi FTP | Yes | Reported observing ball action about 30 minutes after releasing ball sealers (20), as expected; 15 balls (20) were released with HCl acid; the remaining 5 balls (20) were released with fresh water ++ surfactant. |
| Well C Oklahoma 4/15/94 | 24,485 to 24,751 | 388 | 15% HCl and Water | 4259 bbl 10–22 bpm | 154 perfs 100 PBI Ball Sealers (20) 1.05 SG | 8.4 | Inapplicable[5] 12 Mscf/d @ 1500 psi FTP[6] | Yes | New sidetracked completion underwent acid fracture; buoyant ball sealers (20) dropped in four stages of 25; no recovery of balls (20) following job; believe brine afterflush caused balls (20) to sink to bottom of well. |
| Well D Texas 4/14/94 | 13,666 to 13,702 | 390 | Xylene and Water | 277 bbl 7–10 bpm | 72 perfs 60 PBI Ball Sealers (20) 0.80 SG | 8.4 | 1.2 Mscf/d @ 6900 psi FTP 2.2 Mscf/d @ 8000 psi FTP | No | Used xylene to remove near wellbore damage due to drilling mud; believe that formation damage was in pressure expected uniform, thus nominal changes in pressure expected during job; recovered 6-1/2 balls (20); believe rest caught below packer due to tail pipe. |
| Well E Texas 6/15/94 | 11,452 to 11,582 | 285 | Gelled 15% HCl | 850 bbl 9–12 bpm | 170 perfs 120 Alum. Ball Sealers (30) 1.05 SG | 5.4 | Inapplicable[7] 4.5 Mscf/d @ 2900 psi FTP | Yes | X-linked, 40# gel pumped ahead of acid may have contributed to increases in tubing pressures; 27 out of 120 ball sealers (30) re- |

TABLE 5-continued

FIELD TEST RESULTS OF BALL SEALERS DESIGNED FOR HOSTILE WELL ENVIRONMENTS

| Well; Location; and Date | Perf Interval (ft) | BHST (°F.) | Fluids | Total Volume and Rate | No. of Perfs and Balls | BHP[1] (ksi) | Production Rates Before and After | Ball Action | Comments |
|---|---|---|---|---|---|---|---|---|---|
| | | | | | | | | | covered two days later; believe rest caught beneath packer due to tail pipe. |
| Well F Wyoming 6/17/94 | 14,365 to 15,136 | 280 | 15% HCl | 1210 bbl 12–14 bpm | 249 perfs 150 Alum. Ball Sealers (30) 1.05 SG | 7.0 | 34 Mscf/d @ 2000 psi FTP 55 Mscf/d @ 2040 psi FTP | Yes | Ball action more evident during early and latter stages of treatment; catcher installed, but no ball sealer (30) recovery; well currently producing between 40 and 52 Mscf/d; Believe balls (30) sunk to bottom of well once exposed to fresh water afterflush. |

[1]Estimated maximum bottomhole pressure at perforations while pumping or shut-in; BHP = fluid hydrostatic pressure + applied surface pressure − tubing friction pressure.
[2]Estimated.
[3]Pumped a 50/50 mixture of nitrogen-foamed, filtered, heated, fresh water toward end of job at 8–12 bpm.
[4]Rate reported at 11 Mscf/d w/FTP = 1450 psi on 2/21/94, but had dropped to 9.5 Mscf/d on 3/24/94.
[5]Well C recently re-completed.
[6]Rate increased from 12 Mscf/d @ 1500 psi FTP on 4/16/94 to 14.5 Mscf/d @ 1600 psi FTP on 4/20/94.
[7]Well E was recently completed, perforated, then underwent acid stimulation.

Table 6 provides suggested guidelines for selecting the appropriate ball sealer design. The two primary factors to consider when selecting a ball sealer are temperature and pressure. The temperature should equal the estimated maximum bottomhole temperature anticipated during a stimulation treatment. Computer programs known to those skilled in the art can serve as useful tools to estimate this temperature. If such programs are not available, past workover records may provide sufficient information to estimate temperature. Another possibility is to simply use the bottomhole static temperature (BHST). Though the BHST will be higher than the estimated treating temperature, this approach is not necessarily conservative. The reason is that if a break occurs during a workover, or if several hours pass before well production resumes and the balls unseat, the ball sealers might remain seated on the perforations for several hours under static temperature conditions.

Commercial ball sealers appear capable of withstanding, in some instances, hydrostatic pressures up to 15,000 psi (103 MPa) at elevated temperatures up to 250° F. (121° C.). However, the pressure which is often of primary concern is the maximum differential pressure that a ball sealer will experience once seated across a perforation. In many instances, commercial ball sealers will not be able to withstand high differential pressures even though they may have been able to withstand temperatures up to 250° F. and hydrostatic pressures up to 15,000 psi. A good estimate of the differential pressure for a given application is the difference between the maximum bottomhole treating pressure [hydrostatic pressure plus applied surface pressure (wellhead pressure) minus tubing friction pressure] and the reservoir pressure. One problem with this approach is that reservoir pressures may vary along a producing interval depending on the degree of formation damage. Thus, determining the minimum reservoir pressure across a perforated interval is important when estimating the maximum differential pressure. In most cases a differential pressure of 1,500 psi (10 MPa) is a reasonable estimate for the worse case scenario (e.g., when pumping at high rates through a large diameter pipe in a recently perforated well).

Another factor to consider is time. Treatment times are usually not difficult to determine. Most service companies are able to provide these values. A computer spreadsheet program can be used to calculate the time. Yet, because of the inventive ball sealers ability to withstand high hydrostatic pressures, the most critical time for a ball sealer is when it experiences differential pressure: Specifically, when the first ball sealer seats onto a perforation until it releases from it. In most cases, a ball sealer unseats from a perforation once well production resumes after completion of a workover. In other cases, a well may remain shut-in for several hours, or even days, after completion of a workover. Thus, ball sealers may remain seated under hydrostatic pressures and bottomhole static temperatures for extended periods of time. Usually a ball sealer will remain seated for two hours or less. A more conservative time estimate is from eight to 24 hours. The guidelines in Table 6 below are based on data from laboratory and field tests with ball sealer exposure times ranging from two to 24 hours.

TABLE 6

GUIDELINES FOR SELECTING BALL SEALERS

| Criteria (1) Maximum BHT[1] and/or (2) Differential Pressure[2] greater than 1500 psi | BALL SEALER DESIGN |
|---|---|
| 200–300° F. | Hollow Core, Thick-Walled (31), High Strength (7075-T6) Aluminum Ball[3] Sealer (30) With an Ethylene-Propylene Rubber Cover 35 |
| 300–325° F. | Hollow Core, Thick-Walled (31), High Performance Thermoplastic (PEEK, PBI, TORLON) Ball Sealer[3] (20) Without a Cover |
| >325° F. | Hollow Core, Thick-Walled (31), Polybenzimidazole (PBI) Ball Sealer[3] (20) Without a Cover |

[1]Maximum botomhole temperature (BHT) during workover; if uncertain, use bottomhole static temperature (BHST).
[2]Estimated maximum differential pressure across perforation during workover. If The estimated maximum hydrostatic pressure exceeds 15,000 psi (103 MPa), use either a high-strength aluminum ball sealer (30) or a high-performance thermoplastic ball sealer (20).
[3]For hollow core ball sealers, the outer spherical shell diameter should be greater than the expected maximum performation diameter plus 0.25 inches (6.35 mm).

As previously discussed, indications are that commercially available solid phenolic or nylon core balls with a nitrile rubber coating will perform satisfactorily at temperatures below 200° F. (93° C.) with hydrostatic pressures below 15,000 psi (103 MPa) and differential pressures below 1,500 psi (10 MPa). The degree of extrusion, if any, is likely to be nominal at these temperatures and pressures. The majority of stimulation treatments will occur under these conditions. Thus, commercial ball sealers will most likely perform satisfactorily. However, the inventive, more rigid, thick-walled, hollow core designs described herein are preferable if hydrostatic pressures exceed 15,000 psi (103 MPa) to minimize changes in ball sealer density due to bulk contraction of the ball sealer material. Notable changes in ball sealer density will occur, however, if hydrostatic pressures exceed 10,000 psi (69 MPa) when using phenolic as a core material (Novak, 1991). Sometimes bottomhole treating temperatures are below 200° F. (93° C.) with hydrostatic pressures less than 15,000 psi (103 MPa), but differential pressures are estimated to exceed 1,500 psi (10 MPa). In this case the inventive hollow core, thick-walled ball sealer 30 made from a high strength aluminum like 7075-T6 with an ethylene-propylene rubber cover 35 is preferable to the commercially available solid phenolic or nylon core ball sealer.

Laboratory test results indicate that commercial ball sealers with solid nylon or phenolic cores will begin extruding into a perforation as temperatures approach 200° F. (93° C.), with the extrusion rate varying as a function of differential pressure. Thus, when temperatures exceed 200° F. (93° C.), a hollow core (spherical shell 21), thick-walled, high strength aluminum ball sealer 30 covered with an ethylene propylene rubber cover 35 will deform less when compared to a commercially available solid nylon or a phenolic core ball sealer. Indications are that a solid syntactic foam core ball sealer will begin to degrade as temperatures approach 200° to 250° F. (93° to 121° C.), even if hydrostatic pressures are below 15,000 psi (103 MPa) and differential pressures are less than 1,500 psi (10 MPa).

A hollow core, thick-walled ball sealer 30 made from a high strength aluminum like 7075-T6 with an ethylene-propylene rubber cover 35 is preferred when the maximum bottomhole treating temperature is estimated to fall between 200° F. (121° C.) and 300° F. (149° C.). This design should perform satisfactorily even when differential pressures exceed 1,500 psi (10 MPa). Because the maximum working temperature for 7075-T6 aluminum is 300° F. (149° C.), a hollow core, thick-walled ball sealer 20 made from a high performance thermoplastic is preferred when the treating temperature is estimated to fall between 300° F. (149° C.) and 325° F. (163° C.),. The selection of thermoplastic material will depend on the environmental ratings of the material. When the maximum treating temperature is estimated to exceed 325° F. (163° C.), a hollow core, thick-walled ball sealer 20 made from PBI is preferred. Although relatively expensive, a PBI ball sealer 20 is capable of withstanding pressures up to 20,000 psi (137 MPa) at temperatures up to 400° F. (204° C.). Furthermore, because of good environmental ratings a PBI ball sealer 20 (and ball sealers made from most thermoplastic materials) will not require a rubber coating. Additionally, other high-strength thermoplastic materials may be used as an alternative to PBI. Tests to determine the utility of other thermoplastics can be performed by those skilled in the art.

When selecting a vendor for manufacturing or for coating ball sealers, important issues to consider include cost, quality assurance, and production time. For example, ball sealers 30 made from high-strength aluminum and coated with ethylene-propylene rubber are less expensive when compared to ball sealers 20 made from high-performance thermoplastics (without a coating). When ordering ball sealers in lots of 10 or more, costs will likely range from $15 to $20 per ball for a coated ball sealer 30 made from a high-strength aluminum, and $30 to $70 per ball for an uncoated ball sealer 20 made from a high-performance thermoplastic. Though high when compared to a commercial ball sealer (typically $1 per ball), these costs are offset by the assurance that a more effective stimulation treatment will likely occur when using these ball sealers, resulting in improved well productivity. The extra cost is also offset by the possibility of repeated use, particularly when using buoyant, high-performance thermoplastic ball sealers. The various embodiments of the inventive ball sealer designs also enable manufacturers to more easily meet design specifications when compared to methods now used to make commercial ball sealers, resulting in nominal density variation among ball sealers in a given batch. Finally, manufacturers that have machines with computer numeric controls (referred to as CNC machines) are able to make ball sealers in less time and at a lower per ball sealer cost when compared to ball sealers made with manually operated machines.

The capability of a ball sealer to block a perforation will diminish notably if degradation results in excessive ball deformation or in a breakdown of ball material. A ball must remain essentially unreformed and intact under high pressures and temperatures to effectively block a perforation during a workover. Based on laboratory test results, commercial ball sealers are unlikely to perform effectively when exposed to hostile well environments. They deform excessively when exposed to high temperatures and bottomhole pressures often associated with deeper wells, particularly during long workovers or when exposed to solvents. Indications are that, in most cases, commercial ball sealers will begin to extrude into a perforation when bottomhole treating temperatures exceed 200° F. (93° C.). Higher bottomhole pressures will increase the extrusion rate. Furthermore, at these temperatures the nitrile rubber coatings applied to commercial ball sealers will begin to tear once seated on a perforation, thus exposing the core material to potentially degrading solvents like HCl acid. Understandably, service companies are reluctant to recommend the use of their ball sealers during workovers in wells with hydrostatic pressures exceeding 15,000 psi (108 MPa) or with bottom hole static temperatures above 300° F. (149° C.).

As described and illustrated herein, the various embodiments of the present invention satisfy the need for a ball sealer design which will achieved improved diversion effectiveness while conducting a workover inside a cased, hostile environment well. The new design is a low-density ball that can withstand the degradation effects of solvents common to oil and gas wells during a workover. Results of laboratory and field testing indicate that this new ball design is capable of performing effectively inside a cased, perforated well when exposed to high temperatures (200° F.–325° F.), high hydrostatic pressures (>15,000 psi), and high differential pressures (>1500 psi) commonly associated with hostile well environments. The various embodiments of the inventive ball sealer also enables manufacturers to enhance their quality control efforts to ensure that a ball meets customer specifications in terms of ball size, density, and environmental ratings. The new ball sealer designs are a viable alternative for situations where downhole pressures or temperatures exceed the performance limits of commercial ball sealers. Although more expensive, costs are offset by the assurance that a more effective stimulation treatment will likely occur, resulting in improved well productivity.

It should be understood that the invention is not to be unduly limited to the foregoing which has been set forth for illustrative purposes. For example, the rigid, hollow core, low density ball sealer design described herein could also be used as a stopper to plug an opening inside a valve or other types of mechanical equipment. As illustrated by this example, various alternatives and modifications of the invention will be apparent to those skilled in the art without departing from the true scope of the invention as defined in the following claims.

APPENDIX A

BALL SEALER EQUATIONS

For a spherical, thick-walled ball sealer under uniform external pressure, the absolute maximum normal stress in the ball sealer wall is as follows:

$$P=1.5*q*1/[1-(r_i/r_o)^3] \quad (1)$$

where

P=maximum normal stress (psi;Pa), q=uniform external pressure (psi; Pa), $r_o$=outer radius of ball sealer (in.;mm), and $r_i$=inner radius of ball sealer (in.; mm).

Rearranging Equation 1 results in an equation for calculating the allowable uniform external pressure in terms of the allowable normal stress.

$$q_{all}=0.667*P_{all}*[1-(r_i/r_0)^3] \quad (2)$$

where $q_{all}$=allowable uniform external pressure (psi; Pa), and $P_{all}$=allowable material stress (psi; Pa).

The density of an uncoated, spherical, thick-walled ball sealer equals:

$$D_{uncoated}=D_1*[1-(r_i/r_o)^3] \quad (3)$$

where $D_1$=density of the ball sealer material (lb/in$^3$; N/m$^3$).

The density of a coated, spherical, thick walled ball sealer equals:

$$D_{coated}=\{D_1*[1-(r_i/r_o)^3]/[(r_c/r_o)^3]\}+\{D_2*[1-(r_o/r_c)^3]\}$$

where $D_2$=density of the coating material (lb/ins; N/ms), and $r_c$=outer radius of coated ball sealer (in.; mm), with $r_c>r_o>r_i$.

Notes (1) When calculating the allowable uniform external pressure, if available use for the allowable normal stress the compressive yield stress of the ball sealer material; otherwise, use the tensile yield stress.

(2) May use specific gravity (SG) in place of density (D).

(3) When calculating the density of the coated ball ($D_{coated}$), the density of the coating material ($D_2$) should include the density of the adhesive used to bond the coating to the ball.

We claim:

1. A method of treating a subterranean formation surrounding a cased wellbore wherein the casing has an interval provided with a plurality of perforations, said method comprising:

(a) flowing down said casing to said perforated interval a plurality of ball sealers suspended in a treating fluid, each of said ball sealers having a density less than the density of said treating fluid, in the range of about 0.8 g/cc to about 1.3 g/cc, and being sized to substantially seal said perforations; each of said ball sealers further comprised of a spherical shell formed by two halves, said first half having a mating member designed to sealably engage with the mating member of the second half; and wherein the ratio of the spherical shell outer radius to the spherical shell thickness is less than 10; and (b) continuing the flow of said liquid until said ball sealers seal at least a portion of said perforations.

2. The method of claim 1 wherein each of said ball sealers is comprised of a high-strength thermoplastic and said shell thickness is in the range of about 0.031 inches to about 0.250 inches.

3. The method of claim 2 wherein said ball sealers have a temperature resistance up to at least about 400° F. and remain intact at hydrostatic pressures up to at least about 20,000 psi and differential pressures across said perforations up to about 6,500 psi.

4. The method of claim 1 wherein each of said ball sealers is comprised of a high strength aluminum and said shell thickness is in the range of about 0.031 inches to about 0.250 inches.

5. The method of claim 4 wherein said ball sealers have a temperature resistance up to at least about 325° F. and remain intact at hydrostatic pressures up to at least about 15,000 psi and differential pressures across said perforations up to about 1,500 psi.

6. The method of claim 4 wherein each of said ball sealers further comprises an ethylene-propylene cover.

7. The method of claim 1 wherein each of said ball sealers further comprises an inert solid inserted within said spherical shell.

8. The method of claim 1 wherein said mating members comprise a female mating member, having an interior beveled edge and a female lip; and a male mating member having an exterior beveled edge and a male lip; wherein said mating members sealably engage to form a beveled joint.

9. A ball sealer for plugging a passage formed through a vessel; said ball sealer being sized to substantially seal said passage and being comprised of a spherical shell having first and second halves designed to sealably engage, wherein the ratio of the spherical shell outer radius to the spherical shell thickness is less than 10, said ball sealer further having a density in the range of about 0.5 g/cc to about 1.3 g/cc, and said spherical shell comprised of a high-strength material.

10. The ball sealer of claim 9 wherein said high-strength material is a high-strength thermoplastic and said shell thickness is in the range of about 0.031 inches to about 0.250 inches.

11. The ball sealer of claim 10 wherein said high-strength thermoplastic ball sealer has a temperature resistance up to at least about 400° F. and remains intact at hydrostatic pressures up to at least about 20,000 psi and differential pressures up to about 6,500 psi.

12. The ball sealer of claim 9 wherein said ball sealer is comprised of a high strength aluminum and said shell thickness is in the range of about 0.031 inches to about 0.250 inches.

13. The ball sealer of claim 12 wherein said high-strength aluminum ball sealer has a temperature resistance up to at least about 325° F. and remain intact at hydrostatic pressures up to at least about 15,000 psi and differential pressures up to about 1,500 psi.

14. The ball sealer of claim 12 further comprising an ethylene-propylene cover.

15. The ball sealer of claim 9 further comprising an inert solid within said spherical shell.

16. A ball sealer for plugging perforations in a casing comprising a spherical shell having first and second halves designed to sealably engage, wherein the ratio of the spherical shell outer radius to the spherical shell thickness is less than 10, said ball sealer further having a density in the range of about 0.8 g/cc to about 1.3 g/cc, and said spherical shell comprised of a high-strength material.

17. The ball sealer of claim 16 wherein said ball sealer is comprised of a high-strength thermoplastic and said shell thickness is in the range of about 0.031 inches to about 0.250 inches.

18. The ball sealer of claim 17 wherein said high-strength thermoplastic ball sealer has a temperature resistance up to at least about 400° F. and remains intact at hydrostatic pressures up to at least about 20,000 psi and differential pressures up to about 6,500 psi.

19. The ball sealer of claim 16 wherein said high-strength material comprises a high strength aluminum and said shell thickness is in the range of about 0.025 inches to about 0.125 inches.

20. The ball sealer of claim 19 wherein said high-strength aluminum ball sealer has a temperature resistance up to at least about 325° F. and remain intact at hydrostatic pressures up to at least about 15,000 psi and differential pressures up to about 6,500 psi.

21. The ball sealer of claim 19 further comprising an ethylene-propylene cover.

22. The ball sealer of claim 16 further comprising an inert solid within said spherical shell.

* * * * *